US011029090B2

(12) United States Patent
Hanzawa et al.

(10) Patent No.: US 11,029,090 B2
(45) Date of Patent: Jun. 8, 2021

(54) INDUSTRIAL FURNACE AND METHOD OF UTILIZING HEAT THEREFROM

(71) Applicant: NGK INSULATORS, LTD., Nagoya (JP)

(72) Inventors: Shigeru Hanzawa, Nagoya (JP); Takashi Yasue, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 364 days.

(21) Appl. No.: 16/131,552

(22) Filed: Sep. 14, 2018

(65) Prior Publication Data

US 2019/0032999 A1 Jan. 31, 2019

Related U.S. Application Data

(63) Continuation of application No. PCT/JP2017/003834, filed on Feb. 2, 2017.

(30) Foreign Application Priority Data

Mar. 24, 2016 (JP) ..... JP2016-060830

(51) Int. Cl.
*F27B 9/34* (2006.01)
*F27D 7/02* (2006.01)
(Continued)

(52) U.S. Cl.
CPC ..... *F27B 9/34* (2013.01); *F27B 9/243* (2013.01); *F27D 7/02* (2013.01); *F27D 17/00* (2013.01); *F27D 17/004* (2013.01); *F27B 9/36* (2013.01)

(58) Field of Classification Search
CPC ..... C07D 501/24; C07D 501/38; F27B 9/243; F27B 9/34; F27B 9/36; F27D 17/00; F27D 17/004; F27D 7/02; Y02P 20/55
See application file for complete search history.

(56) References Cited

U.S. PATENT DOCUMENTS 4,477,718 A 10/1984 Crain et al.
4,501,318 A * 2/1985 Hebrank ..... F27D 17/004 165/7
(Continued)

FOREIGN PATENT DOCUMENTS

JP S6-146982 A1 11/1981
JP S57-200900 U 12/1982
(Continued)

OTHER PUBLICATIONS

Translation JP 2004225995 (Year: 2020).*
(Continued)

*Primary Examiner* — Ibrahime A Abraham
*Assistant Examiner* — Frederick F Calvetti
(74) *Attorney, Agent, or Firm* — Burr & Brown, PLLC

(57) ABSTRACT

A continuous industrial furnace comprising: an inlet; a heating zone; a cooling zone; and an outlet in this order, the continuous industrial furnace being configured to heat-treat a workpiece while conveying the workpiece from the inlet to the outlet, wherein at least a part of the heating zone comprises a furnace wall heat insulation structure, the furnace wall heat insulation structure comprising: an outer wall having one or more gas introducing ports; and a porous thermal insulation layer arranged with a gap on an inner side of the outer wall; and wherein the heating zone further comprises one or more exhaust ports for sucking and discharging the gas after the gas flows into the heating zone of the furnace from the gas introducing ports through the gap and the porous thermal insulation layer In this order and then flows toward the inlet side.

9 Claims, 5 Drawing Sheets

(51) Int. Cl.

| | |
|---|---|
| ***F27D 17/00*** | (2006.01) |
| ***F27B 9/24*** | (2006.01) |
| *F27B 9/36* | (2006.01) |

(56) References Cited

U.S. PATENT DOCUMENTS

| | | | | |
|---|---|---|---|---|
| 7,875,236 | B2 * | 1/2011 | Bleifuss | F27D 19/00 266/178 |
| 10,337,076 | B2 * | 7/2019 | Millner | F27B 15/10 |
| 2008/0233524 | A1 | 9/2008 | Yasue et al. | |
| 2010/0186644 | A1 * | 7/2010 | Sugitatsu | F27D 17/004 110/203 |
| 2014/0011150 | A1 * | 1/2014 | Miyata | C04B 35/638 432/133 |
| 2014/0127636 | A1 * | 5/2014 | Li | F27B 9/02 432/180 |
| 2016/0348199 | A1 * | 12/2016 | Millner | F27D 17/001 |

FOREIGN PATENT DOCUMENTS

| | | | |
|---|---|---|---|
| JP | S61-008355 | B2 | 3/1986 |
| JP | H03-041295 | A1 | 2/1991 |
| JP | H05-025296 | U | 4/1993 |
| JP | H10-238757 | A1 | 9/1998 |
| JP | 3517372 | B2 | 4/2004 |
| JP | 2004-225995 | A1 | 8/2004 |
| JP | 2005-048984 | A1 | 2/2005 |
| JP | 2010-048440 | A1 | 3/2010 |
| JP | 5051828 | B2 | 10/2012 |

OTHER PUBLICATIONS

English Translation of International Preliminary Report on Patentability, International Application No. PCT/JP2017/003834, dated Oct. 4, 2018 (8 pages).

NEDO Research Report, "Research for Extracting Theme of Thermal Radiation Control Technology Development Aiming at Energy Saving of High Temperature Equipment/Plants, etc.," New Energy and Industrial Technology Development Organization, Mar. 2010, p. 9.

International Search Report and Written Opinion (Application No. PCT/JP2017/003834) dated May 16, 2017.

* cited by examiner

Principle Drawing of Furnace Wall Heat Insulating Gas Supply

FIG. 3 (a) Changes of Furnace Wall Heat Release and Gas Sensible Heat by Supply Gas Flow Rate (Furnace Temperature 1400 ℃, Heat Insulation Thickness 400 mm)
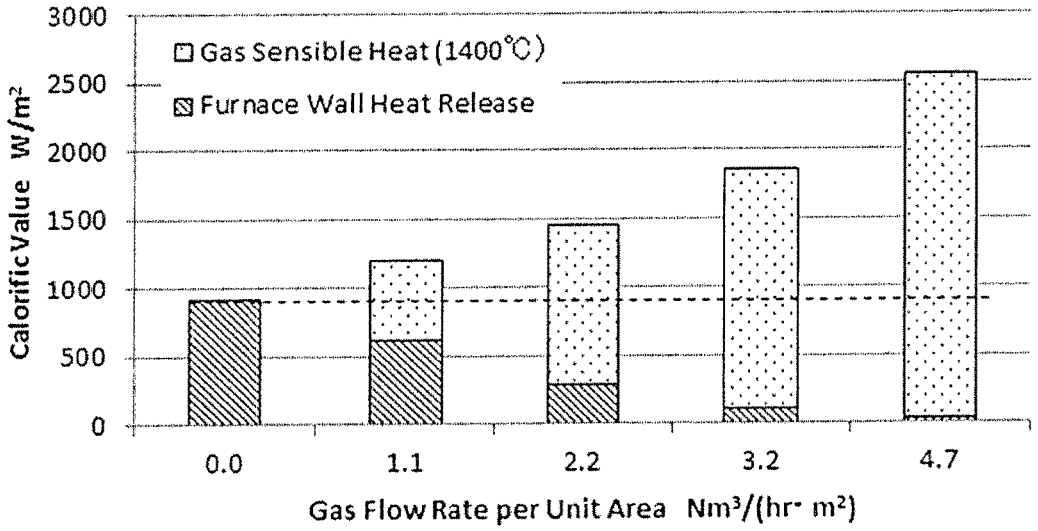
FIG. 3(b) Changes of Furnace Wall Heat Release and Gas Sensible Heat by Supply Gas Flow Rate (Furnace Temperature 1000 ℃, Heat Insulation Thickness 300 mm)
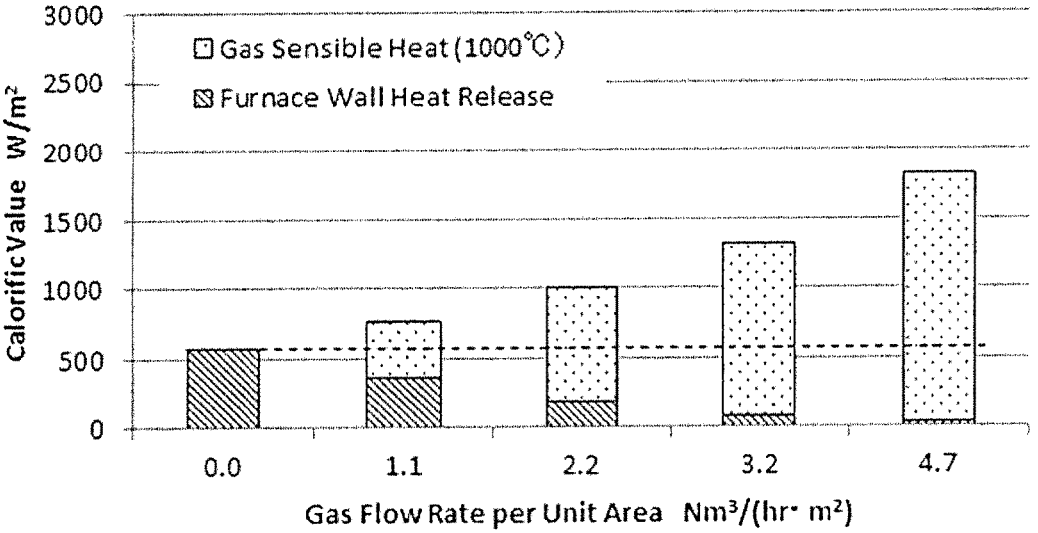

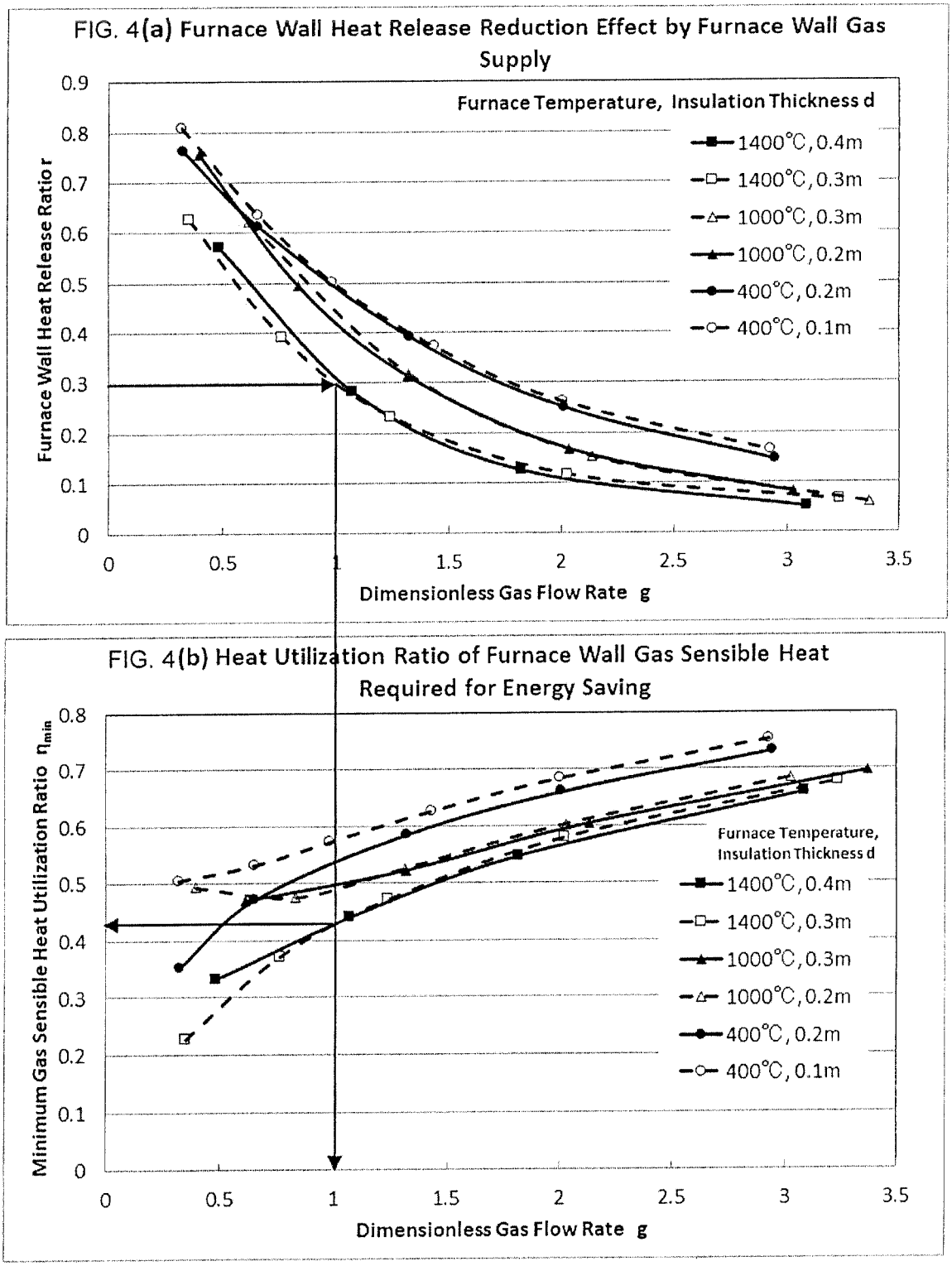
FIG. 4(a) Furnace Wall Heat Release Reduction Effect by Furnace Wall Gas Supply
Furnace Temperature, Insulation Thickness d
1400°C, 0.4m
1400°C, 0.3m
1000°C, 0.3m
1000°C, 0.2m
400°C, 0.2m
400°C, 0.1m
Furnace Wall Heat Release Ratio r
Dimensionless Gas Flow Rate g
0
0.1
0.2
0.3
0.4
0.5
0.6
0.7
0.8
0.9
0.5
1
1.5
2
2.5
3
3.5
FIG. 4(b) Heat Utilization Ratio of Furnace Wall Gas Sensible Heat Required for Energy Saving
Furnace Temperature, Insulation Thickness d
1400°C, 0.4m
1400°C, 0.3m
1000°C, 0.3m
1000°C, 0.2m
400°C, 0.2m
400°C, 0.1m
Minimum Gas Sensible Heat Utilization Ratio $\eta_{min}$
Dimensionless Gas Flow Rate g

INDUSTRIAL FURNACE AND METHOD OF UTILIZING HEAT THEREFROM

TECHNICAL FIELD

The present invention relates to an industrial furnace. The present invention also relates to a method of utilizing heat from the industrial furnace.

BACKGROUND ART

Conventionally, efforts to improve the thermal efficiency of industrial furnaces have been intensively made in view of energy saving. Today, there are increasing demands for improved thermal efficiency because of the global warming problem. To improve the thermal efficiency of the industrial furnace, it is important to reduce heat release from a furnace wall and heat carried off by an exhaust gas, which are two major causes of heat output. Currently, so-called high-performance industrial furnaces are being practically employed and are becoming widespread, which incorporate an inorganic fiber heat insulation material having lower thermal conductivity as a countermeasure for heat release from a furnace wall (e.g., Japanese Patent No. 3517372 B); a heat exchange type burner (Japanese Patent Application Publication No. H10-238757 A) or a regenerative burner (e.g., Japanese Patent No. 5051828 B) as a countermeasure for heat carried off by an exhaust gas.

Further, conventionally the heat carried off by the exhaust gas is routinely recovered by means of a boiler or a heat exchanger and is utilized as a heat source for the furnace itself or other facilities (e.g., Japanese Patent Application Publication No. 2010-48440 A). In recent years, development for further utilizing unused heat for heat storage, cooling, power generation and the like has been progressed, and is being partially put to practical use. In other words, steady progress has been made for reduction of heat carried off by the exhaust gas and utilization of exhaust heat.

On the other hand, the heat release from the furnace wall is hard to further reduce. For the heat release from the furnace wall, it is considered that its outer wall is formed as a double wall and air or water is passed through the inside to recover heat. However, in general, the temperature of the heat is about 100° C., which is considered low as a heat source, and the heat is widely dispersed in terms of area, so that energy is lower, and the facility cost for recovering the heat is not reasonable. Therefore, practical use of effective heat recovery has not been achieved. Further, thermoelectric power generation, thermoacoustic power generation or cold extraction utilizing the heat release from the furnace wall has been developed, but conversion efficiency thereof is still low and it is under development.

In relation to the reduction of an amount of heat release from the furnace wall, an NEDO research report in fiscal 2009 "Research for Extracting Theme of Thermal Radiation Control Technology Development Aiming at Energy Saving of High Temperature Equipment/Plants, etc." introduces, as an advanced thermal insulation method, an active heat insulation method which allows a low temperature gas flowing in an opposite direction to heat transfer to flow through an optically semi-permeable porous layer. Details of the active thermal insulation method are disclosed in Japanese Patent Application Publication No. H03-41295 A, which teaches that the method is used for, in particular, thermal insulation during re-entry of a rocket nozzle or a space shuttle, and thermal protection of a furnace for developing new materials or a nuclear fusion furnace wall.

Moreover, the document discloses that a turnaround time of a blast furnace or the furnace for developing the new materials can be shortened because a thermal insulation layer can be extremely thin and a time to reach the steady state is extremely short, so that effective utilization of equipment and energy saving are possible.

However, the NEDO research report concludes that "although this technology is excellent for thermal insulation, it uses heat transfer due to sensible heat of a gas flowing in an opposite direction to heat input, so that this technology is difficult to be linked to energy saving of the high temperature equipment/plants, etc.". Actually, there is no actual application of the technology.

Further, Japanese Patent Application Publication No. 2005-048984 A proposes a heat treatment furnace in which a refractory having gas permeability is arranged inside a furnace wall along a wall surface of the furnace wall. The heat treatment furnace is characterized in that a gap is provided between the furnace wall and the refractory, and when adjusting an atmosphere in the furnace, an atmosphere adjusting gas having a predetermined composition is supplied to the inside of the furnace after being introduced into the gap and passing through the inside of the refractory. This document discloses that according to the heat treatment furnace, time required for replacing the initial atmosphere in the furnace with a desired atmosphere in the furnace can be significantly shortened when adjusting the furnace atmosphere, and the control of the atmosphere can be further facilitated. It also discloses that by introducing the atmosphere adjusting gas between the furnace wall and the refractory, the furnace wall is cooled by the atmosphere adjusting gas and a temperature of a surface of the furnace wall is lowered as compared with the conventional technique, so that a thermal efficiency of the furnace and safety of work are improved.

CITATION LIST

Patent Literatures

[Patent Document 1] Japanese Patent No. 3517372 B

[Patent Document 2] Japanese Patent Application Publication No. H10-238757 A

[Patent Document 3] Japanese Patent No. 5051828 B

[Patent Document 4] Japanese Patent Application Publication No. 2010-48440 A

[Patent Document 5] Japanese Patent Application Publication No. H03-41295 A

[Patent Document 6] Japanese Patent Application Publication No. 2005-048984 A

Non-Patent Literature

NEDO research report in fiscal 2009, "Research for Extracting Theme of Thermal Radiation Control Technology Development Aiming at Energy Saving of High Temperature Equipment/Plants, etc.", New Energy and Industrial Technology Development Organization, March, 2010, p. 9

SUMMARY OF INVENTION

Technical Problem

Japanese Patent Application Publication No. H03-41295 A suggests that the active thermal insulation method lead to energy saving, but it does not specifically discuss how to achieve energy saving. In fact, the NEDO research report teaches that the active thermal insulation method is difficult to be linked to energy saving. The above patent document discloses that the inflow rate of the working gas is preferably as high as possible, and may be from 0.1 to 1.0 m/s. In Example 1 of the patent document, numerical analysis of an effect of active thermal insulation is carried out at a calorific value of 1 $MW/m^2$, a heat insulation thickness of 10 mm and gas flow rates of 0.08 and 0.8 m/s. However, under these conditions, extremely large exhaust heat loss occurs in terms of operating conditions of general industrial furnaces, and it is thus difficult to lead to energy saving of industrial furnaces.

Further, Japanese Patent Application Publication No. 2005-048984 A discloses that the technique described in the document contributes to improvement of thermal efficiency of the heat treatment furnace. However, it does not disclose any specific structure and mechanism which contribute to the improvement of the thermal efficiency. Rather, the technique described in the paten document is based on the principle of the active thermal insulation method, and a considerable amount of exhaust heat carried off by the exhaust gas is generated when releasing the atmosphere adjusting gas to the outside of the furnace, so that it is difficult to increase the thermal efficiency of the entire furnace.

The present invention has been made in view of the above circumstances. One of objects of the present invention is to provide an industrial furnace which enables to link reduction of heat release of a furnace wall to energy saving. Another object of the present invention is to provide a method of utilizing heat from an industrial furnace, which enables to link reduction of heat release from the furnace wall to energy saving.

Solution to Problem

When applying the above active thermal insulation method to the heat insulation of the furnace wall of the industrial furnace, the heat release from the furnace wall is significantly reduced by flowing gas from the outside of the furnace wall thermal insulation layer made of a porous material toward the inside of the furnace. On the other hand, the flowed gas will enter the furnace. Therefore, as described above, a considerable amount of heat carried off by the exhaust gas is generated when the gas is discharged to the outside of the furnace, so that it is difficult to achieve high efficiency of the entire furnace.

However, from another point of view, the active thermal insulation method can be a technique in which the furnace wall heat release that is said to be difficult to recover/utilize heat can be converted into gas sensible heat which can relatively efficiently realize heat recovery and heat utilization. The present inventors have focused on this point and conducted detailed studies for applicability to the industrial furnaces. As a result, the present inventors have found that the application to the furnace wall in a heating zone and a cooling zone of a continuous industrial furnace at elevated temperature enables the heat utilization in the furnace, so that energy saving can be achieved for the entire system in consideration of utilization of gas sensible heat inside and outside the furnace, and the present inventors have then completed the present invention.

Several embodiments of the present invention can be specified as follows:

(1) A continuous industrial furnace comprising: an inlet; a heating zone; a cooling zone; and an outlet in this order, the continuous industrial furnace being configured to heat-treat a workpiece while conveying the workpiece from the inlet to the outlet, wherein at least a part of the heating zone comprises a furnace wall heat insulation structure, the furnace wall heat insulation structure comprising: an outer wall having one or more gas introducing ports; and a porous thermal insulation layer arranged with a gap on an inner side of the outer wall; and wherein the heating zone further comprises one or more exhaust ports for sucking and discharging the gas after the gas flows into the heating zone of the furnace from the gas introducing ports through the gap and the porous thermal insulation layer In this order and then flows toward the inlet side.

(2) The continuous industrial furnace according to (1), wherein the gas discharged from the exhaust ports has a temperature of from 100 to 600° C.

(3) The continuous industrial furnace according to (1) or (2), wherein the furnace comprises a portion where an internal temperature of the furnace in the heating zone into which the gas flows through the porous thermal insulation layer is 1000° C. or more.

(4) The continuous industrial furnace according to any one of (1) to (3), wherein the gas flowing into the heating zone of the furnace comprises a furnace atmosphere adjusting gas.

(5) A continuous industrial furnace comprising: an inlet; a heating zone; a cooling zone; and an outlet in this order, the continuous industrial furnace being configured to heat-treat a workpiece while conveying the workpiece from the inlet to the outlet, wherein at least a part of the cooling zone comprises a furnace wall heat insulation structure, the furnace wall heat insulation structure comprising: an outer wall having one or more gas introducing ports; and a porous thermal insulation layer arranged with a gap on an inner side of the outer wall; and wherein the cooling zone further comprises one or more exhaust ports for sucking and discharging the gas after the gas flows into the cooing zone of the furnace from the gas introducing ports through the gap and the porous thermal insulation layer In this order and then is utilized for cooling the workpiece.

(6) The continuous industrial furnace according to (5), wherein the gas discharged from the exhaust ports has a temperature of from 100 to 600° C.

(7) A method of utilizing heat of the continuous industrial furnace according to any one of (1) to (4), the method comprising:

supplying gas from the gas introducing ports, the gas sequentially passing through the gap and the porous thermal insulation layer and then flowing into the heating zone of the furnace, wherein heat is exchanged between the gas and the porous thermal insulation layer while the gas passes through the porous thermal insulation layer, whereby a temperature of the gas is increased and heat release from the porous thermal insulation layer to an outside of the furnace is reduced;

allowing the gas flowing into the furnace to flow toward the inlet side, wherein heat is exchanged between the gas and the workpiece while the gas flows through the furnace toward the inlet side, whereby the temperature of the gas is decreased and a temperature of the workpiece is increased;

sucking and discharging the gas after allowing the gas flowing into the furnace to flow toward the inlet side; and utilizing sensible heat of the sucked and discharged gas outside the furnace.

(8) The method according to (7), wherein the gas is discharged outside the furnace after the gas flows into the furnace through the porous thermal insulation layer at a position where an internal temperature of the furnace in the heating zone is 400° C. or more and an average of 40% or more of the sensible heat of the gas is utilized inside the furnace.

(9) A method of utilizing heat of the continuous industrial furnace according to (5) or (6), the method comprising:

supplying gas from the gas introducing ports, the gas sequentially passing through the gap and the porous thermal insulation layer and then flowing into the cooling zone of the furnace, wherein heat is exchanged between the gas and the porous thermal insulation layer while the gas passes through the porous thermal insulation layer, whereby heat release from the porous thermal insulation layer to an outside of the furnace is reduced and a temperature of a surface of the porous thermal insulation layer on the furnace inner side is decreased;

cooling the workpiece by convective heat transfer due to the gas flowing into the furnace and by radiant heat transfer to an inner surface of the furnace wall, and increasing a temperature of the gas flowing into the furnace by heat exchange between the gas and the workpiece while allowing the gas to flow through the furnace;

sucking and discharging the gas after utilizing the gas flowing into the furnace to cool the workpiece; and utilizing sensible heat of the sucked and discharged gas outside the furnace.

(10) A continuous industrial furnace comprising: an inlet; a heating zone; a cooling zone; and an outlet in this order, the continuous industrial furnace being configured to heat-treat a workpiece while conveying the workpiece from the inlet to the outlet, wherein at least a part of the heating zone comprises a furnace wall heat insulation structure, the furnace wall heat insulation structure comprising: an outer wall having one or more gas introducing ports; and a porous thermal insulation layer arranged with a gap on an inner side of the outer wall; and wherein the heating zone further comprises one or more exhaust ports for sucking and discharging the gas after the gas flows into the heating zone of the furnace from the gas introducing ports through the gap and the porous thermal insulation layer In this order and then flows toward the inlet side.

wherein at least a part of the cooling zone comprises a furnace wall heat insulation structure, the furnace wall heat insulation structure comprising: an outer wall having one or more gas introducing ports; and a porous thermal insulation layer arranged with a gap on an inner side of the outer wall; and wherein the cooling zone further comprises one or more exhaust ports for sucking and discharging the gas after the gas flows into the cooing zone of the furnace from the gas introducing ports through the gap and the porous thermal insulation layer In this order and then is utilized for cooling the workpiece.

(11) The continuous industrial furnace according to (10), wherein the gas discharged from each exhaust port of the heating zone and the cooling zone has a temperature of from 100 to 600° C.

(12) The continuous industrial furnace according to (10) or (11), wherein the furnace comprises a portion where an internal temperature of the furnace in the heating zone into which the gas flows through the porous thermal insulation layer is 1000° C. or more.

(13) The continuous industrial furnace according to any one of (10) to (12), wherein the gas flowing into the heating zone of the furnace comprises a furnace atmosphere adjusting gas.

(14) A method of utilizing heat of the continuous industrial furnace according to any one of (10) to (13), the method comprising:

supplying gas from the gas introducing ports of the heating zone, the gas sequentially passing through the gap and the porous thermal insulation layer at the heating zone and then flowing into the heating zone of the furnace, wherein heat is exchanged between the gas and the porous thermal insulation layer at the heating zone while the gas passes through the porous thermal insulation layer at the heating zone, whereby a temperature of the gas is increased and heat release from the porous thermal insulation layer at the heating zone to an outside of the furnace is reduced;

allowing the gas flowing into the heating zone of the furnace to flow toward the inlet side, wherein heat is exchanged between the gas and the workpiece while the gas flows through the furnace toward the inlet side, whereby the temperature of the gas is decreased and a temperature of the workpiece is increased;

sucking and discharging the gas after allowing the gas flowing into the heating zone of the furnace to flow toward the inlet side; and utilizing sensible heat of the gas sucked and discharged from the heating zone outside the furnace.

supplying gas from the gas introducing ports of the cooling zone, the gas sequentially passing through the gap and the porous thermal insulation layer at the cooling zone and then flowing into the cooling zone of the furnace, wherein heat is exchanged between the gas and the porous thermal insulation layer at the cooling zone while the gas passes through the porous thermal insulation layer at the cooling zone, whereby heat release from the porous thermal insulation layer at the cooling zone to an outside of the furnace is reduced and a temperature of a surface of the porous thermal insulation layer on the furnace inner side at the cooling zone is decreased;

cooling the workpiece by convective heat transfer due to the gas flowing into the cooling zone of the furnace and by radiant heat transfer to an inner surface of the furnace wall, and increasing a temperature of the gas flowing into the cooling zone of the furnace by heat exchange between the gas and the workpiece while allowing the gas to flow through the furnace;

sucking and discharging the gas after utilizing the gas flowing into the cooling zone of the furnace to cool the workpiece; and utilizing sensible heat of the gas sucked and discharged from the cooling zone outside the furnace.

(15) The method according to (14), wherein the gas is discharged outside the furnace after the gas flows into the furnace through the porous thermal insulation layer at a position where an internal temperature of the furnace in the heating zone is 400° C. or more and an average of 40% or more of the sensible heat of the gas is utilized inside the furnace.

Advantageous Effects of Invention

The operation of the continuous industrial furnace according to the present invention allow energy saving through reduction of the heat release from the furnace wall, which is effective for the reduction of running costs of the continuous industrial furnace and for countermeasures against global warming. The present invention can be an epoch-making invention which has succeeded in combination of reduction of an amount of heat release from the furnace wall and energy saving, which has been conventionally considered to be a difficult problem.

BRIEF DESCRIPTION OF DRAWINGS

FIGS. 3(*a*) and 3(*b*) are graphs showing trial calculation results of changes in furnace wall heat release and gas sensible heat when changing a flow rate per unit area of a gas flowing through a porous thermal insulation layer.

FIG. 4(*a*) is a graph showing an effect of reducing furnace wall heat release by supplying a furnace wall heat insulating gas; FIG. 4(*b*) is a graph showing a minimum heat utilization ratio $\eta_{min}$ for sensible heat of the furnace wall heat insulating gas required for energy saving as compared to a case where the furnace wall heat insulating gas is not supplied.

DESCRIPTION OF THE PREFERRED EMBODIMENTS

Figure 1:
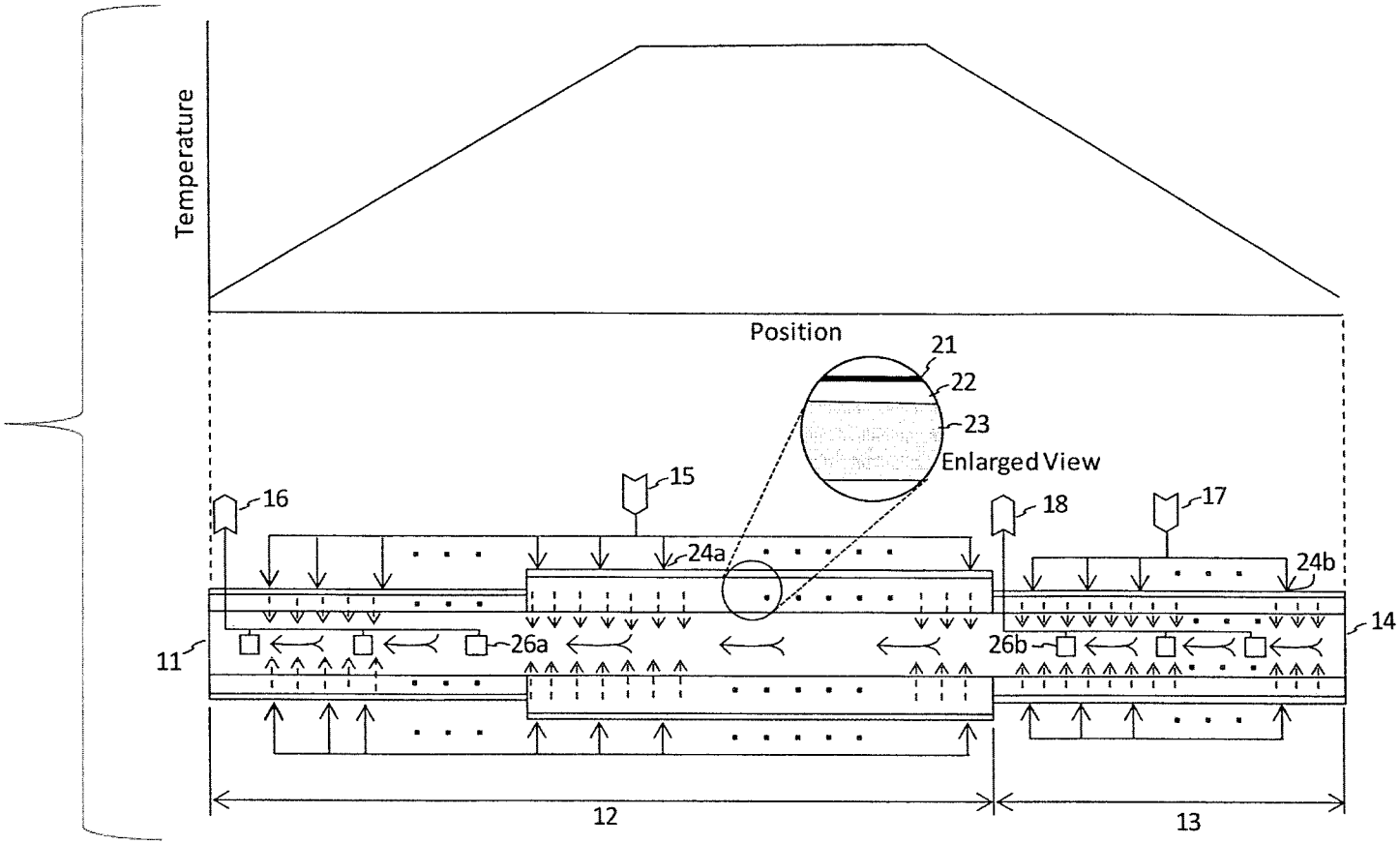
FIG. 1 is a diagram schematically showing a basic configuration and a heat curve along a workpiece traveling direction in a furnace of an embodiment of a continuous industrial furnace according to the present invention.

Hereinafter, embodiments of the present invention will be described in detail with reference to the drawings. FIG. 1 is a diagram schematically showing a basic configuration and a heat curve (temperature profile) along a workpiece traveling direction in a furnace of an embodiment of a continuous industrial furnace according to the present invention. The continuous industrial furnace according to the present embodiment includes: an inlet 11; a heating zone 12; a cooling zone 13; and an outlet 14 in this order, and can carry out a heat treatment while conveying a workpiece (not shown) from the inlet 11 to the outlet 14. As used herein, the heating zone refers to a range in the workpiece traveling direction from the inlet of the continuous industrial furnace to a heating apparatus for heating the inside of the furnace, which is installed at a position closest to the outlet side, and the cooling zone refers to a range in the workpiece traveling direction from a position immediately after the heating equipment installed at the position closest to the outlet side to the outlet of the continuous furnace. To the continuous industrial furnace of the embodiment are connected a furnace wall heat insulating gas supply line 15 and an exhaust line 16 for the heating zone, as well as a furnace wall heat insulating gas supply line 17 and an exhaust line 18 for the cooling zone. At least one, preferably both, of the exhaust line 16 for the heating zone and the exhaust line 18 for the cooling zone can be connected to a heat recovery facility outside the furnace. By allowing a hot gas to flow through the exhaust line 16 and the exhaust line 18, heat can be utilized outside the furnace.

In the present embodiment, the furnace wall heat insulating gas supply lines are separately supplied to the heating zone and the cooling zone. As will be described below, since the heating zone and the cooling zone have different optimum flow rates of the furnace wall heat insulating gas, the adopting of such a configuration allows the gas flow rate to be easily adjusted separately for the heating zone and the cooling zone. However, it is also possible to branch the same gas supply line into lines for the heating zone and the cooling zone, and it is also possible to install, as needed, a flow rate control valve in the gas supply line to adjust the flow rate. It should be noted that in the continuous industrial furnace, air supply and exhaust lines other than those shown in the figure are usually present, but they are herein omitted.

The workpiece is an article subjected to a heat treatment, including, but not particularly limited to, electronic parts such as ferrite and ceramic condensers, semiconductor products, ceramic products, pottery, oxide-based refractories, glass products, metal products, and carbon-based refractories such as alumina/graphite and magnesia/graphite. Further, the workpiece also encompasses a kiln tool. The heating temperature of the workpiece varies depending on the purpose of heating, but the continuous industrial furnace according to the present invention can be suitably employed when heating the workpiece at 1000° C. or more, and typically 1200° C. or more, and more typically 1400° C. or more, for example from 1000 to 2000° C., in terms of effectively exerting an energy saving effect. It should be note that the concept of "heating" includes "firing". By applying it to a furnace with elevated temperature such as a firing furnace, the heat utilization ratio is further improved.

The workpiece entering the furnace from the inlet 11 is subjected to heating in the heating zone and cooling in the cooling zone according to a predetermined heat curve while being conveyed toward the outlet 14. Although the heat curve exemplified in FIG. 1 is a simple trapezoidal curve, it may be a complicated curve having, for example, multiple temperature keeping zones. The method of conveying the workpiece in the furnace is not particularly limited, and it may be, for example, of a carriage type, a pusher type, a roller hearth type or the like. The workpiece subjected to the predetermined heat treatment is taken out from the outlet 14. Examples of the heating method in the heating zone 12 include, but not limited to, heating methods using electric power such as resistance heating, induction heating, dielectric heating, arc heating and radiant heating, as well as heating methods of burning a fuel with a burner (including a heat exchange type burner and a regenerative burner). The cooling method in the cooling zone that can be suitably adopted includes gas cooling methods carried out by supplying a cooling gas into the furnace. In the cooling zone, the workpiece is cooled by convective heat transfer to a cooling gas flowing into the furnace and radiant heat transfer to the inner surface of the furnace wall.

In the continuous industrial furnace according to the present embodiment, the heating zone 12 and the cooling zone 13 can have a furnace wall heat insulation structure including: an outer wall 21 having one, two or more gas introducing ports 24*a*, 24*b*; and a porous thermal insulation layer 23*a* arranged with a gap 22 on an inner side of the outer wall 21. In the continuous industrial furnace, since the heating zone and the cooling zone have a predetermined length in the traveling direction of the workpiece, the heating zone and the cooling zone are preferably provided with two or more gas introducing ports 24*a* and 24*b*, respectively, in accordance with the length of the heating zone and the cooling zone where the furnace wall heat insulation structure is to be installed, such that the furnace wall heat insulating gas is evenly supplied into the furnace. In this case, each of the gas supply lines for the two or more gas introducing ports 24*a*, 24*b* may be branched from a common gas supply line or may be prepared as a dedicated line by individually preparing gas supply equipment. In the case where there is no difference in the type of the furnace wall heat insulating gas to be supplied, the gas supply lines are preferably branched from the same gas supply line, in terms of reducing gas piping laying costs.

Once the furnace wall heat insulating gas is supplied from the gas introducing ports 24*a* through the furnace wall heat insulating gas supply line 15 for the heating zone, the gas sequentially passes through the gap 22 and the porous thermal insulation layer 23 and then flows into the heating zone 12 of the furnace. While the gas passes through the porous thermal insulation layer 23 of the heating zone 12, heat is exchanged between the gas and the porous thermal insulation layer 23, whereby the temperature of the gas is increased and heat release from the porous thermal insulation layer 23 to the outside of the furnace is reduced.

Further, when the furnace wall heat insulating gas is supplied from the gas introducing ports 24*b* through the furnace wall heat insulating gas supply line 17 for the cooling zone, the gas sequentially passes through the gap 22 and the porous thermal insulation layer 23 and then flows into the cooling zone 13 of the furnace. While the gas passes through the porous thermal insulation layer 23 of the cooling zone 13, heat is exchanged between the gas and the porous thermal insulation layer 23, whereby heat release to the outside of the furnace of the porous thermal insulation layer 23 is reduced and the surface temperature of the porous thermal insulation layer 23 on the furnace inner side is decreased.

Thus, in the present embodiment, both of the heating zone 12 and the cooling zone 13 have the furnace wall heat insulation structure according to the present invention, and this embodiment is preferable from the viewpoint of energy saving. However, only one of the heating zone 12 and the cooling zone 13 may have the furnace wall heat insulation structure according to the present invention.

Figure 2:
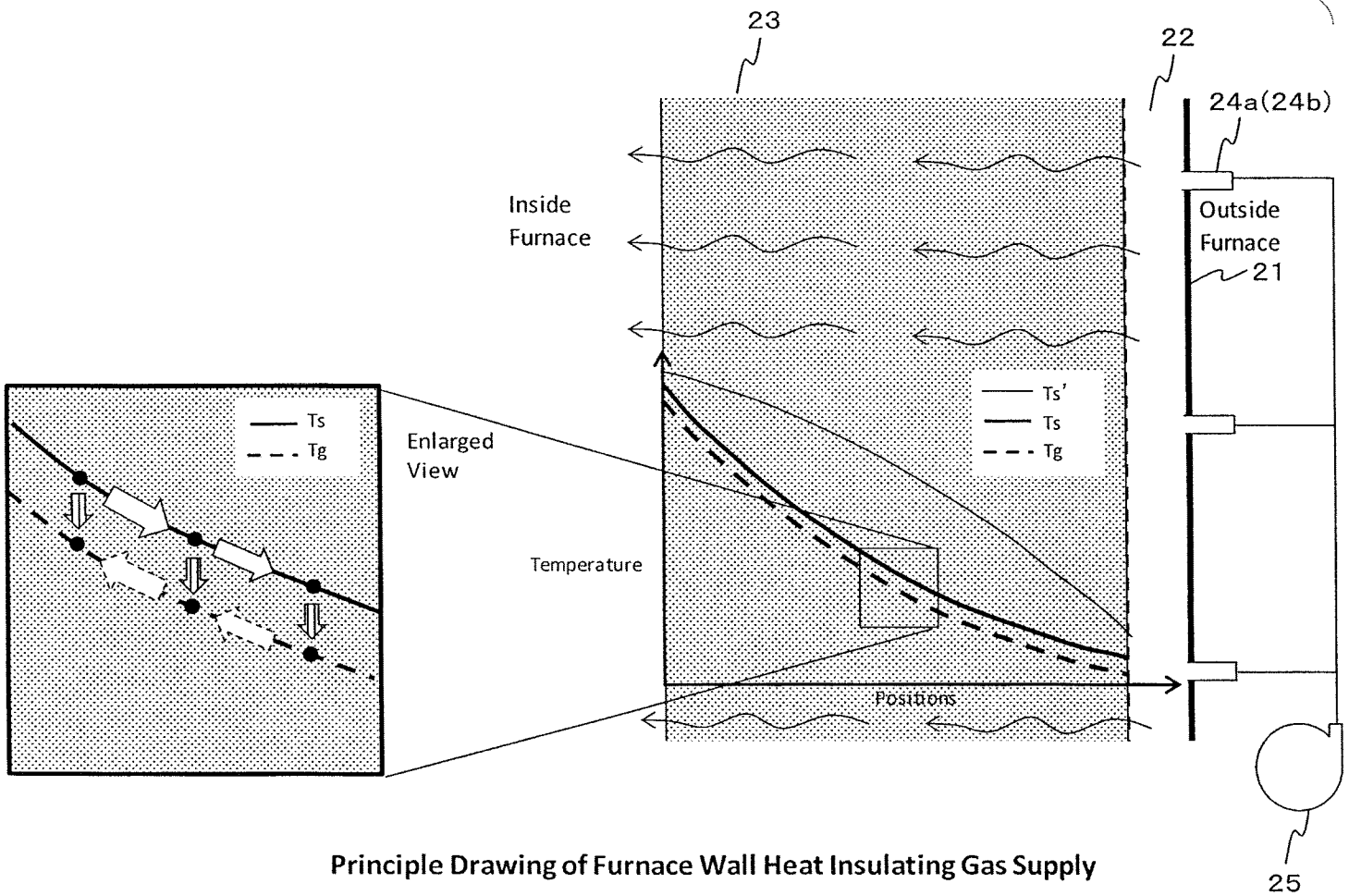
FIG. 2 is a diagram schematically showing a furnace wall heat insulation structure and its heat insulation principle according to the present invention.

While not wishing to be bound by any theory, the furnace wall heat insulation structure and its heat insulation principle according to the present invention are schematically shown in FIG. 2. The principle of reducing the heat release from the furnace wall is simple; since heat is exchanged between the gas and the porous thermal insulation layer 23 while the furnace wall heat insulating gas passes through the porous thermal insulation layer 23 from the outside of the furnace to the inside of the furnace, heat transmitted to the outside of the furnace of the thermal insulation layer 23 is reduced. In the porous thermal insulation layer 23 in a thermal steady state, a heat transfer change of the porous thermal insulation layer 23 (solid), an increase in a gas temperature (change in sensible heat), heat exchange between the thermal insulation layer and the gas are balanced, and a temperature of the thermal insulation layer Ts and a temperature of the gas Tg are linked by a basic equation as shown below.

Heat transfer change of thermal insulation layer=increase in gas temperature=heat exchange between insulation layer/gas:

$$\lambda\cdot(\partial^2 Ts/\partial x^2)=m\cdot Cp\cdot(\partial Tg/\partial x)=Ae\cdot he\cdot{}^*Ts-Tg)$$

with:

Ts: temperature of thermal insulation layer [K] (Ts': at the time when no gas is supplied);

Tg: gas temperature [K];

λ: thermal conductivity in thermal insulation layer (including radiant heat transfer effect) [W/(m·K)];

m: mass flow rate of gas per unit area [kg/($m^2$·s)];

Cp: specific heat of gas [J/(kg·K)];

Ae: surface area of thermal insulation layer per unit volume [$m^2/m^3$]; and he: heat transfer coefficient of thermal insulation layer [W/($m^2$·K)].

When the temperature of the porous thermal insulation layer 23 in the thickness direction under the normal condition (Ts') where no gas is supplied is compared with that under the present invention condition (Ts) where the gas is supplied, there is a difference as roughly shown in FIG. 2. Since the amount of heat release from the furnace wall is a function of the temperature of the outer surface, the amount of heat release from the furnace wall is lowered depending on a decreased fraction of the temperature of the outer surface.

By providing the gap 22 between the outer wall 21 and the porous thermal insulation layer 23, the inflowing gas fills the gap 22 to form a gas layer. This enables the gap 22 to function as a pressure reservoir and the gas to spread over the entire surface of the porous thermal insulation layer 23, so that the gas uniformly flows through the porous thermal insulation layer 23 and an effect of suppressing the heat release is improved. Further, controlling a pressure difference between the pressure reservoir and the inside of the furnace allows stable flowing of the gas at a predetermined flow rate. The flow rate of the gas in the gap should be from 0.1 to 1 m/s in order to allow the gap to function as a uniform pressure reservoir. From this point of view, the thickness of the gap 22 may preferably be from 5 to 50 mm, and more preferably from 10 to 30 mm.

A method of holding the porous thermal insulation layer 23 in a state where the gap 22 is provided between the outer wall 21 and the porous thermal insulation layer 23 includes, but not limited to, a method of fixing the porous thermal insulation layer 23 via a spacer by using a fixing member such as a stud pin, a ceramics pin and a bolt fixed to the outer wall; and a method of fixing the porous thermal insulation layer 23 via a spacer by providing the outer wall with a hole through which a fixing member such as a stud pin, a ceramics pin and a bolt is penetrated. In order to improve controllability of the uniform flow rate, a perforated plate may be installed on the furnace outer side surface of the porous thermal insulation layer 23. Since the perforated plate functions as a resistor for rectification, the uniformity of the gas flow rate passing through the porous thermal insulation layer 23 is increased.

The furnace wall heat insulating gas may be appropriately set taking into account reactivity with the workpiece, an atmosphere in the furnace, costs, specific heat and the like, including, for example, oxidizing gases (air, $O_2$, and the like), inert gases ($N_2$, Ar, He, and the like), reducing gases ($H_2$, CO, and the like). In general, the air may be used in terms of costs. The furnace wall heat insulating gas to be supplied does not need to be heated or cooled from the viewpoint of energy saving, and may be at an ambient temperature (e.g., from 5 to 40° C.).

In some cases, gas may be supplied to the industrial furnace in order to adjust the furnace atmosphere, including, for example, a case where oxygen is required as the atmosphere in the furnace for heat-treating the workpiece in a combustion furnace, a case where an inert gas is supplied into an electric furnace requiring an inert gas atmosphere, a case where a gas such as air is supplied in order to scavenge volatile components generated from the workpiece, and the like. Such atmosphere adjusting gas is not originally supplied as the heat insulating gas, but the atmosphere adjusting gas can be supplied through the porous thermal insulation layer 23 so as to also function as the furnace wall heat insulating gas. In this case, a reduced fraction of the heat release from the furnace wall will be converted into an increased fraction of sensible heat of the gas, and the use of the sensible heat of the gas inside or outside the furnace will produce an energy saving effect. When supplying the atmosphere adjusting gas through the porous thermal insulation layer 23 in the heating zone, the heat release from the furnace wall can be reduced without increasing heat loss of the exhaust gas, and as a result, an effect of decreasing an amount of a fuel used (calorific value) is obtained.

The material and shape of the porous thermal insulation layer 23 are not particularly limited as long as they exhibit general heat insulating performance. Examples of the material of the porous thermal insulation layer 23 that can be suitably used include fibrous materials with higher gas permeability, such as ceramic fiber, alumina fiber and carbon fiber. Since the porous thermal insulation layer itself is soft, it is suitable that the outer wall 21 is made of metal such as iron, an iron alloy, aluminum, a nickel/chromium-based metal, stainless steel or the like, in order to maintain the strength of the furnace body. Examples of the shape of the porous thermal insulation layer 23 include a blanket shape and a board shape, and a required number of these layers may be laminated. Alternatively, the blanket may be folded into a block shape. Further, these shapes may be used in combination with each other. Furthermore, in view of a balance between gas permeability (pressure loss) and heat insulating performance, the porous thermal insulation layer 23 may have a bulk density of from about 100 to 500 kg/m$^3$, and a porosity of from about 0.8 to 0.95. The bulk density can be measured according to JIS R 3311: 1991. The porosity can be calculated by the following equation:

$$\text{Porosity} = 1 - \text{solid volume fraction}$$
$$= 1 - (\text{bulk density}/\text{true density}).$$

Even if the thermal conductivity of the porous thermal insulation layer 23 is large, the effect of the present invention is developed. However, in terms of suppressing heat release as much as possible, the porous thermal insulation layer 23 having a thermal conductivity of from about 0.1 to 1 W/mK (in accordance with JIS A 1412-1: 1999) may be used. The thickness of the porous thermal insulation layer 23 can be set according to the required heat insulating performance, and may be from about 100 to 500 mm.

The portion for employing the furnace wall heat insulation structure according to the present invention in the heating zone 12 may be set according to the heat curve, and it may be the entire region or a partial region of the heating zone 12 in the workpiece traveling direction. When supplying the gas to the porous thermal insulation layer 23 from a plurality of gas introduction ports 24*a* in the heating zone 12, the flow rates of the gas may be the same at all the gas introduction ports 24*a* or may be changed depending on the heat curve. From the viewpoint of improving a utilization efficiency of sensible heat, at least the furnace wall heat insulation structure is preferably employed in a region that will have the maximum temperature of the furnace. For example, the furnace wall heat insulation structure can be employed in a region that will have an elevated temperature of 1000° C. or more, and the furnace wall heat insulating gas can be supplied to this region, thereby improving the energy saving effect.

Similarly, the position for employing the furnace wall heat insulation structure according to the present invention in the cooling zone 13 may be set according to the heat curve, and it may be the entire region or a partial region of the cooling zone 13 in the workpiece traveling direction. When supplying the gas to the porous thermal insulation layer 23 from a plurality of gas introduction ports 24*b* in the cooling zone 13, the flow rates of the gas may be the same at all the gas introduction ports 24*b* or may be changed depending on the heat curve. Conventionally, in the cooling zone, an operation to decrease a temperature of a workpiece to be heated is performed by supplying a cooling gas at a temperature lower than that of the workpiece from a driving port installed on a furnace wall, exchanging heat between the workpiece and the cooling gas, and then discharging the gas. In this case, the cooling gas locally flows into the furnace without substantial heat exchange between the cooling gas and the furnace wall. In contrast, according to the present invention, all or a part of the gas supplied from the driving port can be supplied through the porous thermal insulation layer 23. The employing of the furnace wall heat insulation structure according to the present invention in the cooling zone does not contribute to the reduction of the fuel consumption. However, the reduced fraction of the heat release from the furnace wall will be converted into an increased fraction of sensible heat of the gas, so that by using the sensible heat inside or outside the furnace, the energy saving can be achieved. In general, the required flow rate of the gas per unit area for the cooling zone 13 will be larger than that for the heating zone, although it depends on conditions such as the heat curve. Therefore, the cooling zone can have a heat release ratio of 0.1 or less, according to the trial calculation in FIG. 3 that will be described below, which will be able to further efficiently reduce the heat loss due to the heat release from the furnace wall, as compared with the heating zone 12.

It is preferable that the furnace wall heat insulation structure according to the present invention is arranged in any of the heating zone 12 and the cooling zone 13 so as to surround the entire circumference of the furnace chamber when observing the furnace in a cross-section perpendicular to the workpiece traveling direction, in terms of equalization of the temperature distribution in the furnace and reduction of the heat release from the furnace wall. That is, the furnace wall as used herein is a concept including a side wall of the furnace chamber, a ceiling of the furnace, and a floor of the furnace.

FIGS. 3(*a*) and 3(*b*) show graphs of results obtained by doing trial calculations using the basic equation as described above, for changes of the heat release from the furnace wall and sensible heat of the gas when varying the flow rate of the gas per unit area flowing through the porous thermal insulating layer. The internal temperature of the furnace is 1400° C. (the case of FIG. 4(*a*)) and 1000° C. (the case of FIG. 3(*b*)), and the thickness of the porous thermal insulation layer is 400 mm (the case of FIG. 3(*a*)) and 300 mm (the case of FIG. 3(*b*)), and the thermal conductivity is from 0.1 to 0.6 W/(m·K) (which depends on the temperature), assuming ceramic fiber having a bulk density of about 130 kg/m$^3$. When compared with the furnace wall heat release (905 W/m$^2$ for the case of FIG. 3(*a*); 576 W/m$^2$ for the case of FIG. 3(*b*)) under the normal condition (without supplying of the furnace wall heat insulating gas), the furnace wall heat release when the furnace wall insulating gas is supplied is reduced as the flow rate of the gas is increased. On the other hand, the sensible heat of the supplied gas is increased depending on the flow rate of the gas. As a result, it is found that the combined calorific value of the furnace wall heat release and the gas sensible heat becomes larger than the furnace wall heat release under the normal condition, and the total calorific value is increased as the flow rate of the gas is increased. Therefore, to improve the thermal efficiency as the entire heat utilization system considering the heat utilization inside and outside the furnace by supplying the furnace wall heat insulating gas, it is desirable to utilize inside or outside the furnace approximately half or more of the sensible heat of the gas that will be simultaneously generated.

FIG. 4 explains the above findings in more detail. FIG. 4(*a*) shows a graph of a relationship between a dimensionless gas flow rate (g) and a furnace wall heat release ratio (r), using the temperature of the furnace and the thickness of the thermal insulation layer (d) as parameters. Those skilled in the art will understand the effect of reducing the furnace wall heat release by supplying the furnace gas insulating gas. Here, the horizontal axis of the graph represents a dimensionless flow rate obtained by dividing a heat capacity rate (Cp×G/3.6 [W/(m$^2$·K)]) of the supplied gas by a heat transfer coefficient in the thermal insulation layer (λ/d [W/(m$^2$·K)]), because the flow rate of the gas to be supplied is relevant to the heat insulating performance of the thermal insulation layer from the basic equation shown in FIG. 2. As used herein, the flow rate is referred to as "a dimensionless gas flow rate". It will be understood that the relationship between the dimensionless gas flow rate and the furnace wall heat release ratio does not depend on the heat insulating performance (thickness) of the thermal insulation layer. Further, it will be understood that the higher the furnace temperature, the lower the furnace wall heat release ratio at the same dimensionless gas flow rate. The results indicate that when the furnace wall heat release is to be reduced to at least about 30%, the dimensionless gas flow rate should be from 1 to 2, although it depends on the furnace temperature.

As shown in FIG. 3, the sensible heat of the exhaust gas is generated depending on the supplied amount of the furnace wall heat insulating gas while the furnace wall heat release is reduced. Therefore, in order to reduce the amount of combustion used in the furnace by this method or achieve energy saving as the entire system including the heat utilization outside the furnace, the heat utilization is required for reducing a certain proportion of the generated gas sensible heat, including the inside or outside of the furnace. So, a heat utilization ratio of the gas sensible heat in the case where the calorific value is exactly identical to that under the normal condition with no furnace wall heat insulating gas supply is shown in the graph of FIG. 4(*b*) as a minimum gas sensible heat utilization ratio $\eta_{min}$. Also, in this case, as the internal temperature of the furnace becomes higher, the minimum sensible heat utilization ratio tends to be lower, without depending on the heat insulating performance. Further, it will be understood that under all the conditions, when the flow rate of the furnace wall insulating gas becomes higher, the gas sensible heat utilization ratio must be increased in order to achieve the energy saving.

For example, when the furnace wall heat insulating gas is supplied to a portion having a furnace temperature of 1400° C. and a thermal insulation layer thickness of 0.4 m to set a furnace wall heat release ratio at that portion to 30%, the dimensionless gas flow rate g will be 1. Further, to achieve an energy saving effect by this, the heat utilization ratio η of the generated gas sensible heat should be larger than at least 43%.

The calculation conditions used for creating the graphs in FIGS. 4(*a*) and (*b*) are shown below:

<g: Dimensionless Supplied Gas Flow Rate>

$$g=Cp\cdot G/(\lambda/d)/3.6, \text{ with}$$

Cp: gas heat capacity [J/(kg·K)] (herein, Cp=1.34, which is a constant value);

G: gas flow rate per unit area [Nm$^3$/(hr·m$^2$)] (Nm$^3$ refers to a volume (m$^3$) when converted to a reference state (0° C., 1 atm);

λ: thermal conductivity in thermal insulation layer;

$$\lambda=A\cdot\rho+(B/\rho)\cdot Ts^3+(C\cdot T+D)\cdot\lambda f[\text{W/(m·K)}], \text{ with}$$

Ts: temperature in thermal insulation layer [K];

ρ: bulk density: 130 [kg/m$^3$];

λf: thermal conductivity in stationary gas 0.05 [W/(m·K)];

$$A:6.9\times10^{-5}, B:1.5\times10^{-8}, C:-2.1\times10^{-5}, D:2.0.$$

<r: Ratio of Furnace Wall Heat Release Amount with Furnace Wall Insulating Gas Supply to Furnace Wall Heat Release Amount under Normal Condition>

$$r=Q_w/Q_{w0};$$

$Q_{w0}$: furnace wall heat release amount under normal condition [W/m$^2$];

$Q_w$: furnace wall heat release amount under condition where furnace wall insulating gas is supplied [W/m$^2$].

<$\eta_{min}$: Minimum Required Heat Utilization Ratio of Sensible Heat of Furnace Wall Insulating Gas for Achieving Energy Saving of System>

η: heat utilization ratio of sensible heat of furnace wall supply gas in system;

$$\eta_{min}=1-(Q_{w0}-Q_w)/Q_g, \text{ with}$$

$Q_g$: sensible heat possessed by gas in state where furnace wall insulating gas reaches furnace temperature at supplied position;

$$Q_g=Cp\times G\times(T_i-T_0)[\text{W/m}^2];$$

Ti: temperature in furnace at position where furnace wall heat insulating gas is supplied [° C.];

$T_0$: reference temperature of 20° C.

Simply, the heat utilization ratio η of the generated gas sensible heat is determined by a temperature of sensible heat to be finally abandoned after the sensible heat of the gas supplied from the furnace wall is utilized inside and outside the furnace. When the temperature is simply decreased by diluting with a cooling gas during that process, the heat utilization ratio should be calculated by subtracting the decreased fraction of temperature. As used herein, the cooling gas refers to a cooling gas which is required for additional supply from the dedicated port to the inside of the furnace without passing through the porous thermal insulation layer in order to form a desired heat curve, accompanied by the furnace wall heat insulating gas supply. Therefore, gas originally required to be supplied to the inside of the furnace even if the furnace wall insulating gas is not supplied does not correspond to the cooling gas as used herein. For example, in the cases where cooling air is required for a predetermined heat curve even if the furnace wall heat insulating gas is not supplied, where excessive oxygen is required as the atmosphere in the furnace, and where excessive air is required for agitation in the furnace, such oxygen and air do not correspond to the cooling gas as used herein. Further, in the present invention, when a burner for heating is used, the minimum air ratio required for stable combustion is assumed to be 1.05, and among an part of air which exceeds the ratio, a part of air excluding a part that is required to be originally supplied to the inside of the furnace is considered to be the cooling gas.

Generally, the heat utilization ratio of the generated gas sensible heat is calculated by the following equation:

$$\eta=[1-\Sigma_j Qb_j/\Sigma_i Qa_i]\times 100[\%], \text{ with:}$$

$$Qb_j=Cp\cdot Gb_j\cdot(Tb_j-T_0)/3600;$$

$$Qa_i=Cp\cdot Ga_i\cdot(Ta_i-T_0)/3600;$$

$$\Sigma_j Gb_j=\Sigma_i Ga_i+\Sigma_k Gc_k;$$

$Qb_j$: gas sensible heat [kW] after discharging furnace wall heat insulating gas at position j (in case of heat utilization outside the furnace, after the heat utilization);

$Qa_i$: gas sensible heat [kW] immediately after supplying furnace wall insulating gas into furnace at position i;

Cp: gas specific heat of furnace wall insulating gas [kJ/(Nm$^3$·K)] (for simplicity, Cp=1.34 which is a constant value; Nm$^3$ refers to a volume (m$^3$) when converted to a reference state (0° C., 1 atm);

$T_0$: reference temperature [° C.] (the reference temperature is a temperature of an ambient environment of the furnace, but for simplicity, it is defined as $T_0$=20° C. in the present invention);

$Gb_j$: exhaust gas flow rate of furnace wall insulating gas at position j [Nm$^3$/hr];

$Ga_i$: flow rate of furnace wall heat insulating gas at position i [Nm$^3$/hr];

$Gc_k$: flow rate of cooling gas supplied with furnace wall heat insulating gas supply at position k [Nm$^3$/hr];

$Tb_j$: temperature of furnace wall insulating gas at position j [° C.];

$Ta_i$: temperature of furnace wall heat insulating gas at position i [° C.].

Here, when considering the heat utilization ratio η only inside the furnace, the gas sensible heat $Qb_j$ after exhausting the gas is regarded as the sensible heat of the gas at the exhaust port of the furnace.

If the furnace wall insulating gas is supplied at a temperature zone of 1400° C., heat is utilized inside the furnace without supplying the cooling air on the way and the gas is discharged at a temperature zone of 500° C., then $Ga_1=Gb_1$ and the heat utilization ratio $\eta_{f1}$ inside the furnace will be:

$$\eta_{f1}=1-(500-20)/(1400-20)=65\%.$$

In this case, the calorific value corresponding to 22% (65−43) of the generated gas sensible heat will be fuel reduction inside the furnace. Further, if the exhaust gas having a furnace exhaust temperature of 500° C. could be further utilized at a heat utilization ratio of 50% outside the furnace, then a final exhaust temperature after heat utilization outside the furnace will be 260° C. ((500−20)×0.5+20). Therefore, the heat utilization ratio $\eta_{t1}$ in the entire system will be:

$$\eta_{t1}=1-(260-20)/(1400-20)=83\%.$$

In this case, the calorific value corresponding to 40% (83−43) of the generated gas sensible heat will be the energy saving effect of the entire system.

Further, for example, in the above example, if excessive heat remains in the furnace prior to the evacuation from the furnace, and dilution and cooling is carried out with gas having the same flow rate as the furnace wall gas supply flow rate in order to control the inside of the furnace at a predetermined temperature, then:

$$Gb_2 = Ga_2 + Gc_2$$
$$= 2\cdot Ga_2.$$

The heat utilization ratio $\eta_{f2}$ inside the furnace will be:

$$\eta_{f2}=1-2\times(500-20)/(1400-20)=30\%.$$

In this case, since the minimum gas sensible heat utilization ratio ($\eta_{min}$) is lower than 43%, the amount of fuel used in the furnace will be increased. Further, if heat is utilized outside the furnace under the same conditions as in the above example, then the heat utilization ratio $\eta_{t2}$ of the entire system will be:

$$\eta_{t2}=1-2\times(260-20)/(1400-20)=65\%.$$

In this case, the calorific value corresponding to 22% (65−43) of the generated gas sensible heat will be the energy saving effect of the entire system.

For a batch furnace, it is difficult to utilize the gas sensible heat inside the furnace, and heat will be recovered outside the furnace. In particular, the exhaust gas at an elevated temperature of 1000° C. or higher should be generally cooled to about 500° C., due to restrictions on heat resistance of heat utilization equipment, for example duct equipment such as dampers, and heat exchangers. This operation will lower the efficiency of heat recovery. For example, for comparison with the example of the continuous furnace as described above, when the sensible heat of 1400° C. is simply diluted with air to produce a gas having a temperature of 500° C. in the batch furnace and the heat is then utilized outside the furnace, then the heat utilization efficiency $\eta_{t3}$ of the entire system is $\eta_{t3}$=50%, because it is the heat utilization ratio (50%) itself outside the furnace. In this case, the calorific value corresponding to 7% (50−43) of the generated gas sensible heat will be the energy saving effect of the entire system. However, even in the case of a furnace in which the heat treatment is performed at a temperature of 1400° C., the time during which the furnace temperature is 1400° C. is only temporary, and during the most of the time there is at 1400° C. or less. When the furnace temperature is lower, the minimum gas sensible heat utilization ratio $\eta_{min}$ will exceed 50% from the results of FIG. 4(*b*). Therefore, when evaluating it in one cycle of batch operation, the energy saving effect of the entire system cannot be expected, and rather energy will often be increased.

On the other hand, for the continuous furnace, the gas sensible heat generated at the high temperature portion of the heating zone 12 can be utilized at the lower temperature portion of the heating zone 12. For example, when the furnace wall heat insulating gas flowing into the furnace in the heating zone 12 from the gas inlet 24*a* through the gap 22 and then the porous thermal insulation layer 23 is allowed to flow toward the inlet 11, heat is exchanged between the gas and the workpiece while allowing the gas to flow through the furnace, whereby the temperature of the gas is decreased and the temperature of the workpiece is increased.

This allows effective utilization of the gas sensible heat in the heating zone 12. After flowing through the furnace, the gas can be sucked and discharged from one or more exhaust ports 26*a* installed in the heating zone 12. The flow of the furnace wall insulating gas flowing into the furnace can be controlled by operating a furnace pressure in the furnace length direction by adjusting an amount of supply/discharge.

The position for installing the exhaust port 26*a* at the heating zone 12 may be determined according to the heat curve. In terms of effective utilization of the gas sensible heat inside the furnace, for example as the entire furnace, 50% or more, and preferably 60% or more of the gas sensible heat is preferably utilized for the heating of the workpiece before the gas is discharged. Further, to provide a temperature at which heat is easily utilized outside the furnace, the temperature of the gas discharged from the heating zone 12 may more preferably be from 100 to 600° C., and even more preferably from 250 to 500° C. Therefore, the exhaust port 26*a* of the heating zone is preferably provided at a position where the gas in the furnace is in such a temperature range. This allows utilization of heat at a heat recovery rate of 50% or more outside the furnace. Non-limiting example of the heat utilization outside the furnace include, in addition to direct utilization of the sensible heat at an elevated temperature for heating other workpieces, it may be utilized by converting it to steam, hot water, hot air or the like in heat recovery facilities such as boilers and heat exchangers (water heaters, air preheaters, and the like). It should be noted that if there is no equipment or the like for utilization as a heat source, the utilization efficiency is decreased to 5-20%, but the heat may be further converted to electricity to utilize it.

Further, when the furnace wall heat insulating gas flows into the furnace in the cooling zone 13 by sequentially passing from the gas inlet 24*b* through the gap 22 and the porous thermal insulation layer 23, the workpiece is cooled by convection heat transfer due to the gas. The temperature of the gas flowing into the furnace is increased by heat exchange between the gas and the workpiece while flowing through the furnace. The workpiece is also cooled by radiant heat transfer to the inner surface of the furnace wall. After flowing through the furnace, the gas can be sucked and discharged from one or more exhaust ports 26*b* installed in the cooling zone 13. The position for installing the exhaust port 26*b* in the cooling zone 13 may also be determined according to the heat curve. To provide easy heat utilization outside the furnace, the temperature of the exhaust gas from the cooling zone 13 may preferably be from 100 to 600° C., and more preferably from 250 to 500° C., as with the exhaust gas from the heating zone 12. Therefore, the exhaust port 26*b* of the cooling zone 13 may be preferably provided at a position where the gas in the furnace is within such a temperature range.

According to the trial calculations shown in FIG. 3, even if the furnace wall heat insulating gas is supplied at about 4.7 $Nm^3/(hr \cdot m^2)$ in view of utilization in the cooling zone, the temperature of the gas supplied from the furnace inner side surface of the furnace wall thermal insulation layer to the inside of the furnace is lower than the internal temperature of the furnace by only about 30° C., and the temperature of the inner surface of the furnace wall thermal insulation layer is lower than the internal temperature of the furnace by only about 10° C. In other words, the workpiece (which is cooled in this case) passing through that temperature zone can be subjected to mild cooling by convection heat transfer due to the gas heated to near the internal temperature of the furnace and by radiant heat transfer to the inner surface of the furnace wall thermal insulation layer which has a slightly lower temperature than the internal temperature of the furnace. In general, the workpiece (which is cooled in this case) may cause so-called "cold cracking" due to a rapid cooling operation, such as an operation in which the workpiece is exposed to gases having a larger local temperature difference. However, when cooling the workpiece using the furnace wall heat insulation structure according to the present invention, the cooling operation will become milder, resulting in an advantage that such a trouble can be easily avoided.

In order to improve the thermal efficiency of the entire heat utilization system including heat utilization inside and outside the furnace, the flow rate of each gas supplied to the heating zone and cooling zone is desirably determined by considering a degree of the gas flow rate that will allow effective utilization of heat inside or outside the furnace. As can be seen from the graph of FIG. 3, when an energy saving effect produced by supplying the furnace wall heat insulating gas is sought to be obtained only inside the furnace, as the flow rate of the supplied gas is increased, the gas sensible heat generated simultaneously should be utilized at a higher ratio. Even if the gas sensible heat is effectively utilized to heat the workpiece inside the furnace, excessive gas sensible heat will remain, although it depends on the heat curve. Therefore, in view of the thermal efficiency of the heat utilization outside the furnace, it is not desirable to generate a large amount of the gas sensible heat. As compared with the cooling zone from this view point, the optimal gas flow rate of the furnace wall heat insulating gas supplied to the heating zone will be limited to a relatively lower flow rate, and will depend on specifications of the furnace, such as the calorific value rate of the workpiece, the area of the furnace wall and the heat curve. By way of example, an appropriate flow rate of the gas per unit area may be from 1 to 3 $Nm^3/(hr \cdot m^2)$. Further, in terms of the dimensionless gas flow rate, it may be appropriately in a range of from 0.5 to 3, and preferably in a range of from 1 to 2. If the flow rate is lower than the lower limit, the minimum gas sensible heat utilization ratio will be lower so that the heat utilization can be easily realized, but the quantitative effect is lower in terms of energy. On the other hand, if the flow rate is larger than the upper limit, the minimum gas sensible heat utilization ratio becomes higher, which is not practical. An optimal gas flow rate of the furnace wall heat insulating gas supplied to the cooling zone will also depend on specifications of the furnace, such as the heat value rate of the workpiece, the area of the furnace wall and the heat curve. Considering the purpose of cooling the workpiece, the optimum gas flow rate is generally larger than the optimum gas flow rate of the furnace wall heat insulating gas supplied to the heating zone, and for example, an optimum gas flow rate of from 3 to 6 $Nm^3/(hr \cdot m^2)$ is appropriate.

It is thus possible to achieve both reduction of heat release from the furnace wall and improvement of heat utilization ratio, and to enable energy saving of the entire system including the outside of the furnace, by successfully utilizing inside or outside the furnace the sensible heat of the furnace wall insulating gas. Further, it is also possible to achieve the energy saving effect only inside the furnace by optimizing various conditions, such as the flow rate of each furnace wall heat insulating gas to be supplied to the heating zone and the cooling zone depending on the heat curve; the position for introducing the furnace wall heat insulating gas; and the exhaust position.

EXAMPLES

Hereinafter, Examples of trial calculations of the reduction effect of the furnace wall heat release and the energy saving effect according to the present invention will be provided, but the present invention is not intended to be limited to the Examples.

Examples 1-1 and 2-1, Comparative Examples 1 and 2

Figure 5:
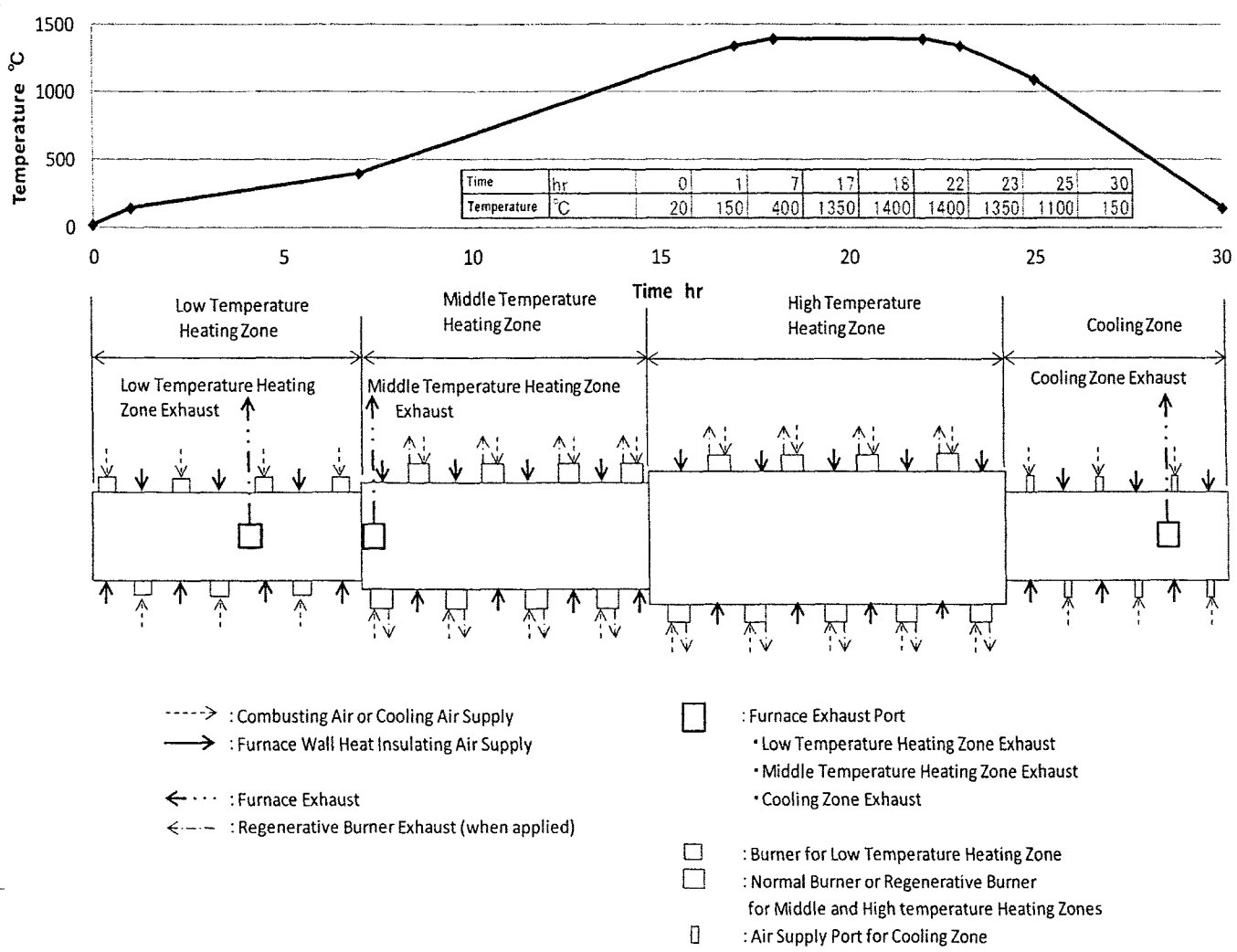
FIG. 5 is a diagram showing conditions of a continuous furnace model, in which trial calculations are carried out for effects of the present invention.

Trial calculations for the effects of the present invention were conducted on the continuous furnace model as shown in FIG. 5 and Table 1. The type of the furnace is a gas burning continuous furnace which had the full length of 90 m, and a width of 2.8 m and a height of 2.1 m as the furnace internal dimensions. As shown in FIG. 5, the continuous furnace was composed of a low temperature heating zone, a middle temperature heating zone, a high temperature heating zone and a cooling zone, from a furnace inlet to a furnace outlet. The in-out time of the furnace was 30 hr, and the internal temperature of the furnace was as shown in the temperature conditions of the table in the heat curve diagram shown in FIG. 5. The maximum temperature of the heating zones was 1400° C. and its retention time was 4 hr. The heat capacity of the workpiece was defined as a heat capacity rate taking its processing rate into consideration, and was 0.465 kW/K in the total of heat capacities of the product and the kiln tool. The furnace was divided into 30 pieces in the direction of the furnace length, and heat balance calculation was carried out for each element having a length of 3 m, based on the described calculation conditions. The area of the furnace wall per an element was 29.4 $m^2$.

It should be noted that for simplification of calculation, the specific heat of the gas in the furnace used for calculating the heat balance was a constant value of 1.34 $kJ/Nm^3$ regardless of the temperature and composition. Further, this trial calculation was conducted under the condition that one burner was installed per element. However, since each element has a length of 3 m, a plurality of burners will be installed per element in the practical continuous furnace.

TABLE 1

Trial Calculation Conditions for Continuous Furnace Model

| Type | | | Gas Burning Continuous Furnace |
|---|---|---|---|
| Fuel | Class | | City Gas (13 A) |
| | Lower Calorific Value | | 41.7 $MJ/Nm^3$ |
| Combustion Gas | Specific Heat (constant irrespective of temperature and gas composition) | | 1.34 $kJ/Nm^3$ |
| Furnace Dimensions | Full Length | | 90 m |
| | Number of Divided Elements in Furnace Length Direction | | 30 |
| | Length of Each Element | | 3 m |
| | Internal Width | | 2.8 m |
| | Internal Height | | 2.1 m |
| | Furnace Wall Surface Area per Element | | 29.4 $m^2$/Eelement |
| Heat Curve (See FIG. 5) | IN-OUT Time | | 30 hr |
| | Maximum Temperature | | 1400° C. |
| | Maximum Temperature Retention | | 4 hr |
| Heat Capacity of Workpiece (Product & Kiln Tool) | | | 0.465 kW/K |
| Furnace Wall Heat Insulating Performance (Normal) *1 | Furnace Wall Outer Surface Temperature | (e.g., at 1400° C. zone) | 130 ° C. |
| | Furnace Wall Heat Release Amount | (e.g., at 1400° C. zone) | 1245 $W/m^2$ |
| Furnace Wall Gas Supply Conditions (See FIG. 3) | Gas Species | | Air |
| | Flow Rate per Unit area | Heating Zone | 2.2 $Nm^3/(hr \cdot m^2)$ |
| | | Cooling Zone | 4.7 $Nm^3/(hr \cdot m^2)$ |
| | Flow Rate per Element | Heating Zone | 64.7 $Nm^3$/(hr · Element) |
| | | Cooling Zone | 138.2 $Nm^3$/(hr · Element) |
| | Heat Release Ratio (vs. Normal) | Heating Zone < 700° C. | 0.40 |
| | | Heating Zone ≥ 700° C. | 0.30 |
| | | Cooling Zone | 0.15 |
| Burner Combustion | Low Temperature Zone | Combustion Gas Flow Rate | 100 $Nm^3$/(hr · Element) |
| | Middle/High Temperature Zone | Air Ratio | 1.05 |
| | | | 20 $Nm^3$/(hr · Element) |
| | Note: Set Minimum Air Flow Rate | | |
| Regenerative Burner Performance *2 | Exhaust Rate (v.s. Burner Combustion Gas Flow Rate | | 90% |
| | Heat Recovery Rate (vs. Burner Combustion Gas Calorific Value) | | 72% |
| | Exhaust Gas Temperature | (e.g, at 1400° C. zone) | 307° C. |

*1 The following equations were used to calculate the outer surface temperature and heat release amount: Outer Surface Temperature Te (° C.) = (100/1370) × (internal temperature of furnace (° C.) − 30) + 30; Heat Release Amount ($W/m^2$) = (0.5 × 5.67 × (((Te + 273)/100)$^4$ − (303/100)$^4$) + 2.3 × (Te − 30)$^{(5/4)}$).

*2 The following equations were used to calculate the regenerative exhaust flow rate and the exhaust gas temperature: Regenerative Exhaust Flow Rate ($Nm^3$/hr) = combustion gas flow rate ($Nm^3$/hr) × exhaust rate (%)/100; Regenerative Exhaust Gas Temperature (° C.) = inner temperature of furnace (° C.) × (1 − heat recovery rate/exhaust rate).

*3: Radiant heat transfer in furnace The radiant heat transfer amount between an element inside the furnace (i) and an element inside the furnace (i + 1) was calculated by: Radiant Heat Transfer (i → i + 1) ($W/m^2$) = Ai × 5.67 × $10^{-8}$ × {(T(i + 1) + 273)$^4$ − (T(i) + 273)$^4$} in which: T(i) and T(i + 1) is an internal temperature of the furnace (° C.), respectively; Ai ($m^2$) is an apparent radiant heat transfer area in the furnace (which was 1 $m^2$ in the trial calculation).

As the heat release from the furnace wall in the normal state without supplying the furnace wall heat insulating gas, a porous thermal insulation layer made of ceramic fiber having relatively good heat insulation property was assumed. In the trial calculation, an amount of heat release was set by the equation shown in "*1" of Table 1. For example, when the internal temperature of the furnace is 1400° C., the furnace outer surface temperature of the porous thermal insulation layer is 130° C., and the furnace wall heat release amount is 1245 $W/m^2$. The furnace wall heat insulating gas to be supplied was air at a temperature of 20° C., which was supplied to the heating zone and the cooling zone. For the gas supply flow rate, the optimum conditions are different between the heating zone and the cooling zone, as described above. In the trial calculation, as shown in FIG. 3, the supply flow rate per unit area was 2.2 $Nm^3/(hr \cdot m^2)$ and 4.7 $Nm^3/(hr \cdot m^2)$ for the heating zone and the cooling zone, respectively, and the heat release ratios of the case where the furnace wall heat insulating gas was supplied to the case where the wall heat insulating gas was not supplied were 0.40, 0.30 and 0.15 for the heating zone having a temperature of less than 700° C., the heating zone having a temperature of 700° C. or more and the cooling zone, respectively. The heat release ratio was changed depending on the temperature zones in the heating zone, taking into account the facts that the thickness of the furnace wall was different depending on the temperature zones, and the heat release ratio was slightly decreased even if the forcing gas flow rates were the same when the heat insulation thickness was the same.

The burner for the low temperature heating zone introduces atmosphere adjusting air to safely remove volatiles from the workpiece. The supply flow rate of air was set such that a combustion gas was generated at 100 $Nm^3/hr$ per element under an excess air condition. The trial calculations were performed for two cases: a normal burner and a regenerative burner, as burners for the middle temperature heating zone and the high temperature heating zone. The air ratio during burner combustion (when heating was required) was about 1.05 for both of the middle temperature heating zone and the high temperature heating zone. However, the minimum air flow rate (20 $Nm^3/hr$) was set for preventing burning damage of metal parts such as a burner nozzle during burning. Further, when the heating zone did not require heating from the viewpoint of creating a target heat curve, but required a cooling operation, a required amount of air at a reference temperature (20° C.) was supplied from the burner so as to have a predetermined temperature. In the cooling zone, a required amount of air at a reference temperature was supplied from a cooling port so as to have a predetermined temperature.

When the furnace wall heat insulation air was supplied (Example), 64.7 $Nm^3/hr$ of air was supplied to the porous thermal insulation layer for each element in the heating zone. In the low temperature heating zone, to generate 100 $Nm^3/hr$ of combustion gas per each element including this furnace wall heat insulation air, an air flow rate corresponding to this difference was supplied from the burner. In the cooling zone, 138.2 $Nm^3/hr$ was supplied to the porous thermal insulation layer for each element, and in this state a required amount of air was also supplied from the cooling port so as to have a predetermined temperature.

The exhaust was carried out at the same position in the cases where the furnace wall heat insulation air was not supplied (Comparative Example) and where the furnace wall heat insulation air was supplied (Example). More particularly, the exhaust was carried out at an exhaust port of the low temperature heating zone (furnace temperature: 296° C.); an exhaust port of the middle temperature heating zone (furnace temperature: 448° C.); an exhaust port of the cooling zone (furnace temperature: 435° C.); and a burner exhaust during the use of the regenerative burner (the exhaust temperature was from about 100 to 300° C. depending on the burner position).

In the heating zone using the normal burner, when direct exhaust is sought to be carried out in that temperature zone, much heat is carried off because the exhaust gas has an elevated temperature, and the design of the exhaust port becomes complicated. Therefore, the direct exhaust is not generally carried out, and the combustion gas generated in the high temperature zone is allowed to flow through the low and middle temperature zones, and is discharged after exchanging heat between the gas and the workpiece. On the other hand, the regenerative burner is a burner in which combustion and exhaust is alternately repeated and the burner itself can recover waste heat, and even if the inner temperature of the furnace is 1000° C. or more, the temperature of the exhaust gas from the burner is about 100 to 300° C. by heat exchange inside the burner. Therefore, the use of the regenerative burner for the heating zone allows direct exhaust from the heating zone. The exhaust flow rate and exhaust gas temperature of the regenerative burner were calculated by the equation as shown in "*2" of Table 1.

Under these conditions, each of sensible heat of the workpiece, heat release from the furnace wall, heat carried off by the exhaust gas and radiant heat transfer in the furnace was calculated for each element, and a required calorific value of the fuel was calculated. The heat carried off by the exhaust gas was calculated from supplied and discharged amounts of the gas in each element and amounts of combustion gas flowing in and flowing out of an adjacent element. The radiant heat transfer in the furnace was calculated by the equation shown in "*3" of Table 1.

The fuel reduction effect according to the present invention was determined by conducting heat balance calculation for the conditions under which no furnace wall heat insulating gas was supplied (Comparative Example) and under which the furnace wall heat insulating gas was supplied (Example) in two cases: use of the normal burner and use of the regenerative burner, determining the most effective combustion, supply and exhaust conditions for each of the cases, and comparing required calorific values and heat carried off by the exhaust gas. The results are shown in Tables 2 and 3. In the continuous furnace model, heat loss due to gas leakage from the inlet and outlet of the continuous furnace is not taken into consideration. However, for example, even if 100 $Nm^3/hr$ of gas flows out at 100° C., the heat loss is only about 3 kW, so that it is a negligible calorific value.

TABLE 2

1. Case of Normal Burner

| | | Comparative Example 1 No Furnace Wall Heat Insulating Gas Supply | | | | | Example 1-1 Furnace Wall Heat Insulating Gas Supply | | | | |
|---|---|---|---|---|---|---|---|---|---|---|---|
| | | | Heating Zone | | | | | Heating Zone | | | |
| | | Entire Furnace | Low Temp. | Mid Temp. | High Temp. | Cooling Zone | Entire Furnace | Low Temp. | Mid Temp. | High Temp. | Cooling Zone |
| Heat Input (kW) | Fuel Calorific Value A | 1336 | 268 | 129 | 938 | 0 | 1251 | 253 | 11 | 987 | 0 |
| Heat Output (kW) | Workpiece (Product & Kiln Tool) Sensible Heat | 60 | 177 | 353 | 30 | −500 | 60 | 177 | 353 | 30 | −500 |
| | Furnace Wall Heat Release | 571 | 27 | 137 | 314 | 94 | 163 | 11 | 44 | 94 | 14 |
| | Heat Carried Off by Exhaust Gas *1 | 699 | 69 | −303 | 435 | 498 | 1023 | 70 | −328 | 704 | 578 |
| | Radiation Loss | 4 | −5 | −58 | 159 | −92 | 4 | −5 | −58 | 159 | −92 |
| Heat Utilization Ratio η (%) of Furnace Wall Heat Insulating Gas inside Furnace *2 | | | | — | | | — | — | 26 | 55 | — |
| | | | | | | | | | Average 45 | | |
| Exhaust Heat from Exhaust Port (Including Burner Exhaust) | Exhaust Port | — | Low Temp. Zone | Mid Temp. Zone | Burner | Cooling Zone | — | Low Temp. Zone | Mid Temp. Zone | Burner | Cooling Zone |
| | Temperature (° C.) | — | 296 | 448 | — | 435 | — | 296 | 448 | — | 435 |
| | Enthalpy (kW) | 699 | 98 | 194 | — | 408 | 1023 | 98 | 437 | — | 488 |
| | Exergy (kW) | 249 | 28 | 72 | — | 149 | 369 | 28 | 163 | — | 179 |
| Heat Utilization B of Exhaust Gas outside Furnace (kW) *3 | | | | 350 | | | | | 512 | | |
| Substantial Calorific Value A-B (KW) of Entire System | | | | 986 | | | | | 740 | | |
| Reduction Effect of Fuel Calorific Value inside Furnace (%) | | | | | | | | | 6 | | |
| Increasing Effect of Heat Utilization of Exhaust Gas outside Furnace (%) | | | | | | | | | 46 | | |
| Substantial Calorific Value Reduction Effect of Entire System (%) | | | | | | | | | 25 | | |

2. Case of Regenerative Burner

| | | Comparative Example 2 No Furnace Wall Heat Insulating Gas Supply | | | | | Example 2-1 Furnace Wall Heat Insulating Gas Supply | | | | |
|---|---|---|---|---|---|---|---|---|---|---|---|
| | | | Heating Zone | | | | | Heating Zone | | | |
| | | Entire Furnace | Low Temp. | Mid Temp. | High Temp. | Cooling Zone | Entire Furnace | Low Temp. | Mid Temp. | High Temp. | Cooling Zone |
| Heat Input (kW) | Fuel Calorific Value A | 1244 | 268 | 388 | 587 | 0 | 1081 | 253 | 210 | 619 | 0 |
| Heat Output (kW) | Work (Product & Kiln Tool) Sensible Heat | 60 | 177 | 353 | 30 | −500 | 60 | 177 | 353 | 30 | −500 |
| | Furnace Wall Heat Release | 571 | 27 | 137 | 314 | 94 | 163 | 11 | 44 | 94 | 14 |
| | Heat Carried Off by Exhaust Gas *1 | 608 | 69 | −44 | 85 | 498 | 853 | 70 | −130 | 335 | 578 |
| | Radiation Loss | 4 | −5 | −58 | 159 | −92 | 4 | −5 | −58 | 159 | −92 |
| Heat Utilization Ratio η (%) of Furnace Wall Heat Insulating Gas inside Furnace *2 | | | | — | | | — | — | 44 | 68 | — |
| | | | | | | | | | Average 60 | | |
| Exhaust Heat from Exhaust Port (Including Burner Exhaust) | Exhaust Port | — | Low Temp. Zone | Mid Temp. Zone | Burner | Cooling Zone | — | Low Temp. Zone | Mid Temp. Zone | Burner | Cooling Zone |

TABLE 2-continued

| | | | | | | | | | | |
|---|---|---|---|---|---|---|---|---|---|---|
| Temperature (° C.) | — | 296 | 448 | 253 | 435 | — | 296 | 448 | 271 | 435 |
| Enthalpy (kW) | 608 | 98 | 17 | 85 | 408 | 853 | 98 | 190 | 78 | 488 |
| Exergy (kW) | 206 | 28 | 6 | 22 | 149 | 298 | 28 | 71 | 21 | 179 |
| Heat Utilization B of Exhaust Gas outside Furnace (kW) *3 | | | 304 | | | | | 427 | | |
| Substantial Calorific Value A-B (KW) of Entire System | | | 940 | | | | | 655 | | |
| Reduction Effect of Fuel Calorific Value inside Furnace (%) | | | | | | | | 13 | | |
| Increasing Effect of Heat Utilization of Exhaust Gas outside Furnace (%) | | | | | | | | 40 | | |
| Substantial Calorific Value Reduction Effect of Entire System (%) | | | | | | | | 30 | | |

*1 Including an increase and a decrease in the gas sensible heat due to flowing into and out of adjacent zone. Minus means flowing into the zone.

*2: A ratio for which the sensible heat of the gas supplied from the furnace wall in the middle temperature zone and the high temperature zone was utilized as a heat source for the heating zone in the furnace.

Specifically, $\eta = [1 - \Sigma_j Q'b_j/\Sigma_j Qa_i] \times 100$ [%]

$Q'b_j = Cp \cdot Gb_j \cdot (Tb_j - 20)/3600$ $Qa_i = Cp \cdot Ga_i \cdot (Ta_i - 20)/3600$ $\Sigma_j G'b_j = \Sigma_i Ga_i + \Sigma_k Gc_k$ $Q'b_j$: gas sensible heat at position j upon discharging of furnace wall supply gas from furnace [kW]

$Qa_i$: gas sensible heat at position i immediately after supplying furnace wall supply gas into furnace [kW]

Cp: gas specific heat of furnace wall supply gas [kJ/(Nm$^3$ · K)] (for simplicity, Cp = 1.34, a constant value)

$G'b_j$: furnace exhaust gas flow rate of furnace wall supply gas at position j [Nm$^3$/hr]

$Ga_i$: flow rate of furnace wall supply gas at position i [Nm$^3$/hr]

$Gc_k$: flow rate of cooling gas supplied with furnace wall gas supply at position k [Nm$^3$/hr]

*3: It was assumed that 50% of the heat carried off by the exhaust gas from the exhaust port of the furnace could be utilized outside the furnace.

(Ref.: Power of Furnace Wall Gas Supply Fan: 2.1 kW)

Table 2 will be explained. Table 2 shows results of heat input and heat output, a heat utilization ratio of the furnace wall heat insulating gas inside the furnace, heat of the exhaust gas from the exhaust port, utilization of heat of the exhaust gas outside the furnace, and a substantial calorific value of the entire system, as results of the heat balance. Table 2 also shows a fuel calorific value reduction effect inside the furnace, an effect of increasing the heat utilization of the exhaust gas outside the furnace, and an effect of reducing the substantial calorific value of the entire system, as the effects of Examples versus Comparative Examples based on those results.

First, heat input and heat output are shown in kW unit for the entire furnace and each temperature zone as the heat balance results. The heat input is only a fuel calorific value A, and the details of the heat output show sensible heat of the workpiece, heat release from the furnace wall, heat carried off by the exhaust gas and radiation loss. Here, some of the details of the heat output in each temperature zone may be heat inputs, but in this case, they are shown by minus indication for the sake of simplicity. For example, when the heat carried off by the exhaust gas is in the minus indication, it indicates that the heat of the exhaust gas has been carried in. It should be noted that the heat carried off by the exhaust gas in each temperature zone includes not only the heat discharged from the exhaust port but also an increase and a decrease in the gas sensible heat associated with the flowing of the gas into and out of the adjacent zone.

The heat utilization ratio of the furnace wall heat insulating gas inside the furnace represents a ratio for which the gas sensible heat has been utilized as a heat source for the heating zone until the gas is discharged from the furnace to the outside of the furnace after the gas is supplied from the furnace wall in the middle temperature zone and the high temperature zone and the temperature is increased to the internal temperature of the furnace inside the furnace wall. More particularly, the heat utilization ratio was calculated by the equation shown in Table 2. In calculating the sensible heat of the furnace wall at the time when the furnace wall heat insulating gas supplied in each element is exhausted at the exhaust port of the furnace, if the cooling air is supplied together, it is necessary to add the flow rate of the cooling air to the flow rate of the furnace exhaust gas. Here, since the flow rates of the furnace wall gas supply from the respective elements of the middle temperature zone and the high temperature zone were set to be the same, the flow rate of the furnace exhaust gas was calculated in such a way that if there was an element(s) where the cooling air was supplied, the gas flow rate of the cooling air was evenly distributed to all the elements where the furnace wall heat insulating gas was supplied including that element(s) in question and those closer to the furnace outlet side than that element(s), and the evenly distributed cooling gas flow rate was added to the supply flow rate of the furnace wall heat insulating gas from each element. It should be noted that for the low temperature zone and the cooling zone, the heat utilization ratio of the furnace wall heat insulating gas inside the furnace was omitted because it was not directly related to the fuel reduction or energy saving effect of the entire furnace.

The table shows the heat carried off by the exhaust gas in each temperature zone in the details of the heat output. The table also shows the heat carried off by the exhaust gas from the exhaust port (including the burner exhaust) in order to indicate heat carried off to the outside of the furnace in each temperature zone. It should be noted that if the heat carried off is utilized by a heat recovery facility outside the furnace, the calorific value should be evaluated not only by enthalpy of the total calorific value but also by the energy which indicates effective energy. Therefore, they are also shown in the table. The utilization of waste heat outside the furnace (B) was defined as being able to utilize 50% or more of the heat carried off by the exhaust gas of the entire furnace for other steps. The table also shows a substantial calorific value (A-B) of the entire system, obtained by subtracting the utilization of the waste heat (B) outside the furnace from the fuel calorific value (A) by heat input inside the furnace.

1. Case when Normal Burner is Used (Example 1-1, Comparative Example 1)

A required calorific value when using the normal burner was 1251 kW for Example, whereas it was 1336 kW for Comparative Example. The fuel reduction rate was 6%. First, when comparing the details of the heat output for the entire furnace, it is found that in Example, the heat release from the furnace wall is significantly reduced due to the effect of the furnace wall heat insulating gas supply, while the heat carried off by the exhaust gas is increased.

Then, comparison was conducted in the respective temperature zones. In the low temperature zone, the fuel calorific value is reduced from 268 kW (Comparative Example) to 253 kW (Example), although a difference between them is only 15 kW. It will be understood from the details of the heat input that this is due to the reduced fraction of the furnace wall heat release. This is because the flow rate fraction of air supplied from the furnace wall also contributes to the scavenging of volatile components from the workpiece, so that in Example, an amount of air supplied from the burner is reduced accordingly so as not to increase the total amount of air supplied to the low temperature zone, and this is because the fraction of air supplied from the furnace wall instead is preheated by exchanging heat between the fraction and the thermal insulation layer of the furnace wall.

In the middle temperate zone, the calorific value is reduced from 129 kW (Comparative Example) to 11 kW (Example), and the calorific value reduction is as large as 118 kW. In view of the details, the reason for this would be that the heat release from the furnace wall was significantly reduced, and the heat carried-in by the exhaust gas (minus indication for heat carried off) was also slightly increased. More detailed analysis shows that the furnace-inside heat utilization ratio of the furnace wall heat insulating gas only in the middle temperature zone is 26%, indicating that, as described in FIG. 4, the supplying of the furnace wall heat insulating gas to the middle temperature zone does not lead to fuel reduction inside the furnace. In addition, the facts that in the middle temperature zone the heat carried-in by the exhaust gas is more than the heat carried off by the exhaust gas (minus indication for the heat carried off) and that the exhaust heat from the exhaust port is significantly increased indicate that the heat carried from the adjacent high temperature zone is significantly increased, which would be a true reason for the fuel reduction in the middle temperature zone.

In the high temperature zone, the fuel calorific value is increased from 938 kW (Comparative Example) to 987 kW (Example), which is an increase by 49 kW. In view of the details of the heat output, the reason for this would be that the heat release from the furnace wall is significantly reduced, while the heat carried off by the exhaust gas is further increased. This is a natural consequence based on the principle of the furnace wall heat insulating gas supply as explained in FIG. 3. Extracting the heat balance only of the high temperature zone of the continuous furnace is substantially the same as looking at the heat balance of the batch furnace, indicating that in the batch furnace, the furnace wall insulating gas supply approach is difficult to be linked to energy saving of the furnace. In the continuous furnace, the increased heat carried off by the exhaust gas in the high temperature zone is brought in the adjacent middle temperature zone and the heat is utilized in the middle temperature zone, thereby allowing energy saving as the entire furnace. The furnace-inside heat utilization ratio of the furnace wall heat insulating gas only in the high temperature zone is 55%, indicating that heat recovery is possible even only inside the furnace.

In addition, the average furnace-inside heat utilization ratio of the furnace wall heat insulating gas in the middle temperature zone and the high temperature zone is 45%, which is close to the minimum gas sensible heat utilization ratio $\eta_{min}$ in view of the graph of FIG. 4. However, such a fuel reduction effect was obtained because the combustion furnace that secures a required calorific value by combustion provides a synergistic effect of reducing combusting air as the required calorific value is reduced.

Since combustion was not carried out in the cooling zone, the heat carried off by the exhaust gas was simply increased by a degree corresponding to the reduction of heat release from the furnace wall by supplying the furnace wall heat insulating gas, and the increased amount was 80 kW. In the trial calculation example, for the sake of simplicity, the supply flow rate of the furnace wall insulating gas was constant over the entire cooling zone. However, the heat release from the furnace wall may be further reduced by optimizing the gas supply amount of the furnace wall insulating gas according to the cooling heat curve, thereby increasing the heat carried off by the exhaust gas.

The results are summarized. The fuel reduction effect inside the furnace was 6%, the effect of increasing the heat utilization of the exhaust gas outside the furnace was 46% assuming that 50% of the heat carried off by the exhaust gas could be recovered in the other steps, and based on these results, the substantial calorific value reduction effect was 25%. A significant energy saving effect was obtained.

2. Case when Regenerative Burner is Used
(Example 2-1, Comparative Example 2)

The required fuel calorific value when using the regenerative burner was 1,081 kW for Example, whereas it was 1,244 kW for Comparative Example. The fuel reduction rate was 13%, which was more effective than when using the normal burner. When comparing the details of heat output for the entire furnace, it can also be seen that the heat release from the furnace wall is significantly reduced due to the effect of the furnace wall heat insulating gas supply in Example, while the heat carried off by the exhaust gas is increased. As compared with the case where the normal burner is used, the increased fraction of the heat carried off by the exhaust gas is smaller, so that the fuel reduction rate of the entire furnace becomes larger.

Next, comparison is made in the respective temperature zones. For the low temperature zone and the cooling zone, the trial calculation conditions are the same as those of the case where the normal burner is used, and the results are also the same. In the middle temperate zone, the fuel calorific value is decreased from 388 kW (Comparative Example) to 210 kW (Example) and a difference between them is 178 kW, which is much lower than the case where normal burner is used (118 kW). The reason for this would be that as compared with the case where the normal burner is used, the increased fraction of the heat carried-in by the exhaust gas (minus indication for the heat carried off by the exhaust gas) is larger although the reduction of the heat release from the furnace wall is the same, and the furnace-inside heat utilization ratio of the furnace wall heat insulating gas is increased from 26% to 44% for the middle temperate zone, and from 55% to 68% for the high temperature zone, and from 45% to 60%, on average, for both. Further, its primal cause would be that in the regenerative burner, 90% of the combustion gas generated by the burner combustion can be exhausted by the burner itself, and thus the flow rate of the exhaust gas discharged at the exhaust port disposed at a beginning part of the middle temperature zone after passing through the middle and high temperature zones toward the inlet side of the furnace is extremely lower than that of the normal burner. In other words, under the normal burner condition, the combustion exhaust gas generated in the high temperature zone flows into the middle temperature zone and is utilized as a heat source for the meddle temperate zone even if the furnace wall heat insulating gas is not supplied, so that the sensible heat newly generated by supplying the furnace wall heat insulating gas cannot be fully utilized inside the furnace and will be left over. As a result, the supply of simple cooling air was necessary to create a predetermined heat curve and to lower the exhaust gas temperature with the cooling air before it is discharged from the furnace. On the other hand, in the case of the regenerative burner, the heat utilization ratio inside the furnace was improved for the reason that since the gas flow from the high temperature zone to the middle temperature zone is inherently lower, the sensible heat generated by supplying the furnace wall heat insulating gas can be effectively and completely utilized in the middle temperature zone. However, since Example 1-1 and Example 2-1 have the same calorific value generated by supplying the furnace wall heat insulating gas, in Example 2-1 the exhaust heat carried off outside the furnace will be reduced since more heat can be utilized inside the furnace.

In the high temperature zone, the fuel calorific value was increased from 587 kW (Comparative Example) to 619 kW (Example), which was an increase by 32 kW. The increased amount was lower than the normal burner condition, which is because of the fact that the fuel calorific value is originally lower due to the effect of the regenerative burner.

The results are summarized. The fuel reduction effect inside the furnace was 13%, the effect of increasing the heat utilization of the exhaust gas outside the furnace was 40% assuming that 50% of the heat carried off by the exhaust gas could be recovered in the other steps, and based on the results, the substantial calorific value reduction effect was 30%, which was more effective than the case where the normal burner was used.

Examples 1-2 to 1-5, Examples 2-2 to 2-5

In Examples 1-1 and 2-1, the trial calculations of the energy saving effect according to the present invention in the continuous furnace were conducted under conditions that the furnace wall heat insulating gas was supplied to all of the low temperature heating zone, the middle temperature heating zone, the high temperature heating zone and the cooling zone. Here, the furnace wall heat insulating gas supply positions were selected in combination as shown in Table 3, and the heat balance was calculated. Other conditions were the same as those in Example 1-1 for the case where the normal burner was used, and those in Example 2-1 for the case where the regenerative burner was used. Based on the heat balance calculation, the fuel reduction effect according to the present invention was determined. The results are shown in Table 3.

TABLE 3

Summary of Calculation Results

| | | | Example # | | | | | | | | | |
|---|---|---|---|---|---|---|---|---|---|---|---|---|
| | | | 1-1 | 1-2 | 1-3 | 1-4 | 1-5 | 2-1 | 2-2 | 2-3 | 2-4 | 2-5 |
| | | | Normal Burner | | | | | Regenerative Burner | | | | |
| Supplied Positions of Furnace Wall Heat Insulating Gas | Heating zone | Low Temp. | ○ | | | ○ | | ○ | | | ○ | |
| | | Mid Temp. | ○ | | ○ | | ○ | ○ | | ○ | | ○ |
| | | High Temp. | ○ | ○ | ○ | ○ | | ○ | ○ | ○ | ○ | |
| | Cooling Zone | | ○ | ○ | ○ | ○ | ○ | ○ | ○ | ○ | ○ | ○ |
| Furnace-inside Heat Utilization Ratio of Furnace Wall Heat Insulating Gas (%) *1 | | | 45 | 51 | 45 | 51 | 42 | 60 | 68 | 60 | 68 | 44 |
| Reduction Effect of Fuel Calorific Value inside Furnace (%) | | | 6 | 5 | 5 | 7 | 0 | 13 | 11 | 12 | 12 | 1 |
| Increasing Effect of Heat Utilization of Exhaust Gas outside Furnace (%) | | | 46 | 32 | 46 | 32 | 24 | 40 | 27 | 40 | 27 | 27 |
| Substantial Heat Reduction Effect of Entire System (%) | | | 25 | 19 | 23 | 21 | 9 | 30 | 23 | 29 | 25 | 10 |

*1: Utilization ratio inside the furnace is calculated for the gas sensible heat fraction of the furnace wall heat insulating gas supplied in the middle temperature zone and the high temperature zone.

A similar tendency was observed for both the cases where the normal burner was used and the regenerative burner was used. For both the cases, the energy saving effect was obtained, but the energy saving effect of the entire system was improved in the order of the case where the furnace wall heat insulating gas was supplied to the middle temperate zone and the cooling zone (Examples 1-5, Example 2-5), the case where the furnace wall heat insulating gas was supplied to the high temperature zone and the cooling zone (Example 1-2, Example 2-2), the case where the furnace wall heat insulating gas was supplied to the low temperature zone, the high temperature zone and the cooling zone (Example 1-4, Example 2-4), the case where the furnace wall heat insulating gas was supplied to the middle temperature zone, the high temperature zone and cooling zone (Example 1-3, Example 2-3), and the case where the furnace wall heat insulating gas was supplied to all of the low temperature heating zone, the middle temperature heating zone, the high temperature heating zone and the cooling zone (Example 1-1, Example 2-1).

The results demonstrate that the energy saving effect can be obtained for each of the low temperature heating zone, the middle temperature heating zone and the high temperature heating zone by supplying the furnace wall heat insulating gas, and the contribution of the effect is increased in the order of the low temperature heating zone, the middle temperature heating zone and the high temperature heating zone.

INDUSTRIAL APPLICABILITY

The continuous industrial furnace according to the present invention can be effectively used in industrial fields that employ a continuous furnace at a high temperature of more than 1000° C., such as, for example, ceramic industry, electronic parts manufacturing industry, ceramic manufacturing industry, glass manufacturing industry, refractory manufacturing industry, and steel industry.

DESCRIPTION OF REFERENCE NUMERALS

11 inlet
12 heating zone
13 cooling zone
14 outlet
15 gas supply line for furnace wall heat insulating gas for heating zone
16 exhaust line for heating zone
17 gas supply line for furnace wall heat insulating gas for cooling zone
18 exhaust line for cooling zone
21 outer wall
22 gap
23 porous thermal insulation layer
24*a*, 24*b* gas introducing port
25 blower
26*a*, 26*b* exhaust port

What is claimed is:

1. A continuous industrial furnace comprising: an inlet; a heating zone; a cooling zone; and an outlet in this order, the continuous industrial furnace being configured to heat-treat a workpiece while conveying the workpiece from the inlet to the outlet, wherein at least a part of the cooling zone comprises a furnace wall heat insulation structure, the furnace wall heat insulation structure comprising: an outer wall having one or more gas introducing ports; and a porous thermal insulation layer having a lower surface, at least one side surface, and an upper surface, and defining a gap between the upper surface thereof and an inner side of the outer wall;

wherein the at least one side surface of the porous thermal insulation layer contacts at least a portion of an outer surface of the cooling zone;

wherein an inflowing gas in the gap defines a gas layer covering the upper surface of the porous thermal insulation layer; and wherein the cooling zone further comprises one or more exhaust ports for sucking and discharging the gas after the gas flows into the cooling zone of the furnace from the gas introducing ports through the gap and the porous thermal insulation layer in this order and then is utilized for cooling the workpiece.

2. The continuous industrial furnace according to claim 1, wherein the gas discharged from the exhaust ports has a temperature of from 100 to 600° C.

3. A method of utilizing heat of the continuous industrial furnace according to claim 1, the method comprising:

supplying gas from the gas introducing ports, the gas sequentially passing through the gap and the porous thermal insulation layer and then flowing into the cooling zone of the furnace, wherein heat is exchanged between the gas and the porous thermal insulation layer while the gas passes through the porous thermal insulation layer, whereby heat release from the porous thermal insulation layer to an outside of the furnace is reduced and a temperature of a surface of the porous thermal insulation layer on the furnace inner side is decreased;

cooling the workpiece by convective heat transfer due to the gas flowing into the furnace and by radiant heat transfer to an inner surface of the furnace wall, and increasing a temperature of the gas flowing into the furnace by heat exchange between the gas and the workpiece while allowing the gas to flow through the furnace;

sucking and discharging the gas after utilizing the gas flowing into the furnace to cool the workpiece; and utilizing sensible heat of the sucked and discharged gas outside the furnace.

4. A continuous industrial furnace comprising: an inlet; a heating zone, a cooling zone; and an outlet in this order, the continuous industrial furnace being configured to heat-treat a workpiece while conveying the workpiece from the inlet to the outlet, wherein at least a part of the heating zone comprises a furnace wall heat insulation structure, the furnace wall heat insulation structure comprising: an outer wall having one or more gas introducing ports; and a porous thermal insulation layer having a lower surface and an upper surface, and defining a gap between the upper surface thereof and an inner side of the outer wall;

wherein the heating zone further comprises one or more exhaust ports for sucking and discharging the gas after the gas flows into the heating zone of the furnace from the gas introducing ports through the gap and the porous thermal insulation layer in this order and then flows toward the inlet side;

wherein at least a part of the cooling zone comprises the furnace wall heat insulation structure;

wherein the lower surface of the porous thermal insulation layer contacts an outer surface of the heating zone continuously along a length thereof;

wherein the at least one side surface of the porous thermal insulation layer contacts at least a portion of an outer surface of the cooling zone;

wherein an inflowing gas in the gap defines a gas layer covering the upper surface of the porous thermal insulation layer; and wherein the cooling zone further comprises one or more exhaust ports for sucking and discharging the gas after the gas flows into the cooling zone of the furnace from the gas introducing ports through the gap and the porous thermal insulation layer in this order and then is utilized for cooling the workpiece.

5. The continuous industrial furnace according to claim 4, wherein the gas discharged from each exhaust port of the heating zone and the cooling zone has a temperature of from 100 to 600° C.

6. The continuous industrial furnace according to claim 4, wherein the furnace comprises a portion where an internal temperature of the furnace in the heating zone into which the gas flows through the porous thermal insulation layer is 1000° C. or more.

7. The continuous industrial furnace according to claim 4, wherein the gas flowing into the heating zone of the furnace comprises a furnace atmosphere adjusting gas.

8. A method of utilizing heat of the continuous industrial furnace according to claim 4, the method comprising:

supplying gas from the gas introducing ports of the heating zone, the gas sequentially passing through the gap and the porous thermal insulation layer at the heating zone and then flowing into the heating zone of the furnace, wherein heat is exchanged between the gas and the porous thermal insulation layer at the heating zone while the gas passes through the porous thermal insulation layer at the heating zone, whereby a temperature of the gas is increased and heat release from the porous thermal insulation layer at the heating zone to an outside of the furnace is reduced;

allowing the gas flowing into the heating zone of the furnace to flow toward the inlet side, wherein heat is exchanged between the gas and the workpiece while the gas flows through the furnace toward the inlet side, whereby the temperature of the gas is decreased and a temperature of the workpiece is increased;

sucking and discharging the gas after allowing the gas flowing into the heating zone of the furnace to flow toward the inlet side; and utilizing sensible heat of the gas sucked and discharged from the heating zone outside the furnace;

supplying gas from the gas introducing ports of the cooling zone, the gas sequentially passing through the gap and the porous thermal insulation layer at the cooling zone and then flowing into the cooling zone of the furnace, wherein heat is exchanged between the gas and the porous thermal insulation layer at the cooling zone while the gas passes through the porous thermal insulation layer at the cooling zone, whereby heat release from the porous thermal insulation layer at the cooling zone to an outside of the furnace is reduced and a temperature of a surface of the porous thermal insulation layer on the furnace inner side at the cooling zone is decreased;

cooling the workpiece by convective heat transfer due to the gas flowing into the cooling zone of the furnace and by radiant heat transfer to an inner surface of the furnace wall, and increasing a temperature of the gas flowing into the cooling zone of the furnace by heat exchange between the gas and the workpiece while allowing the gas to flow through the furnace;

sucking and discharging the gas after utilizing the gas flowing into the cooling zone of the furnace to cool the workpiece; and utilizing sensible heat of the gas sucked and discharged from the cooling zone outside the furnace.

9. The method according to claim 8, wherein the gas is discharged outside the furnace after the gas flows into the furnace through the porous thermal insulation layer at a position where an internal temperature of the furnace in the heating zone is 400° C. or more and an average of 40% or more of the sensible heat of the gas is utilized inside the furnace.

* * * * *